US010717181B2

(12) United States Patent
Cougar

(10) Patent No.: US 10,717,181 B2
(45) **Date of Patent: *Jul. 21, 2020**

(54) ROOFING AND NAIL REMOVAL HAMMER

(71) Applicant: COUGAR HOLDINGS, LLC, Martinsville, VA (US)

(72) Inventor: Daniel D. Cougar, Greensboro, NC (US)

(73) Assignee: Cougar Holdings, LLC, Martinsville, VA (US)

( * ) Notice: Subject to any disclaimer, the term of this patent is extended or adjusted under 35 U.S.C. 154(b) by 455 days.

This patent is subject to a terminal disclaimer.

(21) Appl. No.: 14/997,236

(22) Filed: Jan. 15, 2016

(65) Prior Publication Data

US 2016/0129574 A1 May 12, 2016

Related U.S. Application Data

(63) Continuation of application No. 14/468,264, filed on Aug. 25, 2014, now Pat. No. 9,259,829.

(51) Int. Cl.

| | |
|---|---|
| ***B25D 1/04*** | (2006.01) |
| ***B25D 1/06*** | (2006.01) |
| ***B25G 1/10*** | (2006.01) |

(52) U.S. Cl.

CPC ..... *B25D 1/04* (2013.01); *B25D 1/06* (2013.01); *B25G 1/102* (2013.01); *B25D 2250/285* (2013.01)

(58) Field of Classification Search

CPC . B25D 1/00; B25D 1/04; B25D 1/045; B25D 1/06; B25D 1/12; B25D 1/14; B25G 1/01; B25G 1/02; B25G 1/10; B25G 1/102; B25G 1/105

See application file for complete search history.

(56) References Cited

U.S. PATENT DOCUMENTS

| | | | | |
|---|---|---|---|---|
| 209,803 | A | 11/1878 | Dyson | |
| 771,419 | A | 10/1904 | Conover | |
| 1,725,416 | A * | 8/1929 | Pfister | B25D 1/04 254/26 R |
| 1,934,706 | A | 11/1933 | Green | |
| D118,700 | S | 1/1940 | Griffith | |

(Continued)

*Primary Examiner* — Orlando E Aviles
*Assistant Examiner* — Seahee Yoon
(74) *Attorney, Agent, or Firm* — Miles & Stockbridge P.C.; David R. Schaffer

(57) ABSTRACT

An apparatus including a head having a hammering portion and an oppositely arranged claw portion, the claw portion curving downwardly and away from the top side of the head toward the handle and including a back end with at least four flat ended teeth separated by at least three, substantially equal "V"-shaped grooves centered on a longitudinal axis of the head with inner edges of each of the "V"-shaped grooves being tapered along opposite sides of the "V"-shaped groove from adjacent a front of each of the at least four teeth toward a sharp notch formed at a junction of the sides of the "V"-shaped groove and from a top side of each of the at least four teeth inwardly toward a bottom side of each of the at least four teeth, the outer two of the at least four teeth having substantially equal terminal widths that are wider than the at least inner two of the at least four teeth and all of the at least four teeth being substantially equal in length.

34 Claims, 25 Drawing Sheets

(56) References Cited

U.S. PATENT DOCUMENTS

D185,948 S 8/1959 Schmidt
4,086,699 A * 5/1978 Olkkola ..... A47L 13/08 254/131.5
4,242,780 A 1/1981 Littman
4,336,832 A 6/1982 Poulos
D301,679 S 6/1989 Kokkinos
D322,548 S 12/1991 Dingman
5,178,048 A * 1/1993 Matechuk ..... B25D 1/06 81/125
5,588,343 A * 12/1996 Rust ..... B25G 1/102 81/20
5,845,364 A * 12/1998 Chen ..... B25G 1/01 16/436
5,911,795 A * 6/1999 Tucker ..... B25G 1/102 76/103
6,202,511 B1 * 3/2001 Murray ..... B25G 1/01 81/20
6,283,449 B1 * 9/2001 Hu ..... B25D 1/045 254/26 R
6,386,070 B1 5/2002 Hong
6,913,246 B1 * 7/2005 Skach ..... B25C 11/00 254/131
7,934,441 B1 * 5/2011 Hyde ..... B25B 13/463 7/143
8,534,643 B2 9/2013 Lombardi
8,567,760 B2 * 10/2013 Sindt ..... B25C 11/00 254/25
D695,087 S 12/2013 Vaughan
9,259,829 B1 2/2016 Cougar
2005/0005457 A1 1/2005 Wensel
2007/0089571 A1 * 4/2007 Chen ..... B25D 1/045 81/23
2010/0299843 A1 * 12/2010 Dapkins, Jr. ..... B25F 1/00 7/138
2011/0155979 A1 * 6/2011 Sindt ..... B25C 11/00 254/131
2013/0263382 A1 * 10/2013 Sindt ..... B25C 11/00 7/166
2016/0039078 A1 * 2/2016 West ..... B25D 1/12 81/22

* cited by examiner

ROOFING AND NAIL REMOVAL HAMMER

TECHNICAL AREA

Hammers and more particularly hammers with multiple teeth for removal of nails.

SUMMARY

One or more embodiments can include a hammer with multiple teeth and a ribbed/grooved handle and rounded handle bottom. Some embodiments can include a hammer with multiple teeth and a substantially smooth handle and flat handle bottom. Some embodiments of both smooth and ribbed/grooved handle hammers can include a nail groove with a magnet positioned in the nail groove to hold a nail for initial hammering into a board, i.e., usually a wooden or like material board. Some embodiments can include an integrally formed/molded metal head and handle as well as a metal head with a replaceable handle that can be made of wood, resin, plastic, fiberglass and/or a graphite fiber-reinforced material. All embodiments are designed to simultaneously pull multiple nails.

BRIEF DESCPRIPTION OF THE DRAWINGS

Non-limiting and non-exhaustive embodiments of the present invention are described with reference to the following figures, wherein like reference numerals and/or indicia refer to like parts throughout the various views unless otherwise precisely specified.

DETAILED DESCPRIPTION

Figure 1:
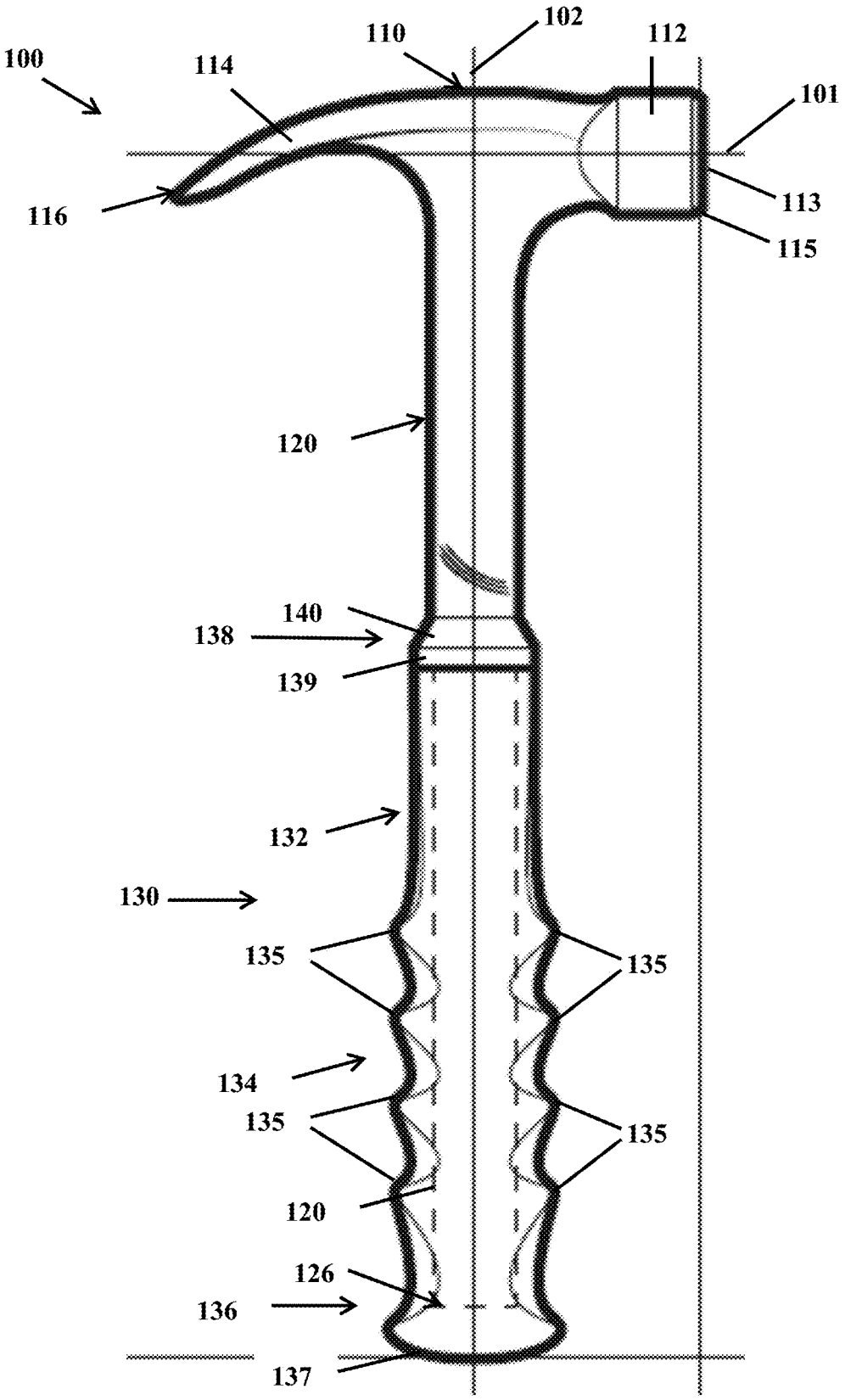
FIG. 1 is a right side view of a roofing and nail removal hammer with a ribbed grip, in accordance with an embodiment of the present invention.

In general, one or more embodiments of the present invention include (i.e., comprise) a hammer that includes a head having a hammering portion with a face and an oppositely arranged claw portion, the claw portion has an end with at least four flat ended, teeth separated by at least three, substantially equally sized "V"-shaped grooves centered on a longitudinal axis of the head; and a handle formed contiguously with the head and extending perpendicularly down from a bottom of the head. The claw portion is configured to be used to simultaneously pull multiple nails that have been driven into a substrate, for example, but not limited to, wood. Specifically, the claw portion curves downwardly and away from the top side of the head toward the handle, each tooth tapers toward the flat end, and the inside edges of the "V"-shaped grooves taper inwardly from a top side of each tooth toward a bottom side of each tooth to aid in getting under nail heads and prying them up. Embodiments of the face can include flat and smooth, flat and checkered (i.e., it has a cross-hatched grooved face), convex and smooth, convex and checkered, etc., as well as other shapes and surfaces. The hammer can further include a grip affixed to and surrounding a bottom portion of the handle from above a middle of the handle to below and surrounding a bottom end of the handle. The grip includes a downwardly and outwardly tapering upper portion to a middle portion from which the grip continues tapering downwardly and inwardly toward the bottom end of the handle with an outwardly tapering bottom portion and a substantially flat end. The grip further includes a cap portion attached to a top end of the upper portion and the cap portion including a bottom portion of the cap extending upwardly away from and substantially parallel to the upper portion of the grip and a top portion of the cap extending diagonally inwardly from the bottom toward and affixing to the handle. The hammer head and handle can be made using a variety of materials, including, but not limited to, high carbon, heat-treated steel. While the embodiments shown herein indicate a unitary head and handle construction, in other contemplated embodiments, the head and handle can be constructed separately, and can be made of the same as well as different materials (e.g., the head can be made of metal and the handles can be made of metal, wood, plastic, fiberglass and/or a graphite fiber-reinforced material), and then attached to each other during an assembly process. The grips can be made from a variety of materials, including, but not limited to, leather, synthetic rubber, elastomeric compounds, and high-impact resins (e.g., polycarbonate resins). In the various embodiments of the present invention, weights of the head can range, for example, from 7 to 28 ounces and lengths of the handle can range, for example, from 12 to 18 inches, although hammers with heavier heads and longer handles can be more useful in heavy construction and demolition. Specifically, the multiple teeth in the embodiments of the hammer of the present invention are designed to be used by construction professionals to, for example, but not limited to, more efficiently: remove shingles and the nails holding the shingles to existing building roofs; remove existing flooring and/or subflooring and the nails holding the flooring and/or subflooring in place; and multiple nails.

FIG. 1 is a right side view of a roofing and nail removal hammer with a ribbed grip, in accordance with an embodiment of the present invention. In FIG. 1, a hammer 100 is shown to include a head 110, for example a 16 to 20 ounce head, with a longitudinal axis 101, a hammering portion 112 and an oppositely arranged claw portion 114, the claw portion 114 including a back end 116 with at least four teeth separated by at least three, substantially equal "V"-shaped grooves centered on the longitudinal axis 101 of the head. The claw portion 114 curves downwardly and away from the topside of the head toward the handle, which provides a fulcrum to remove shingles, flooring, nails, etc. For example, the "V"-shaped grooves are only about ¾ to 1 inch deep, which is at least 50 to 75% or more less deep than a nail groove in a standard hammer, which generally is at least 1½ to 1¾ inches deep. The hammering portion 112 includes a face 113, which is shown to be substantially flat and smooth, but in other embodiments the face 113 may be slightly convex, rounded and/or flat and with and without a checkering pattern. A beveled or chamfered edge 115 tapers inwardly from an outer surface of the hammering portion 112 towards and connects to and around an outer circumference of the face 113. The hammer 100 further includes a handle 120 formed contiguously with the head 110 and extending perpendicularly down and away from a bottom side of the head 110 with a vertical axis 102 that is perpendicular to the longitudinal axis 101 of the head. The hammer 100 still further includes a grip 130 affixed to and surrounding a bottom portion of the handle 120 from approximately above a middle of the handle 120 to below and surrounding a bottom end 126 of the handle 120, the grip 130 includes a downwardly and outwardly tapering upper portion 132 connected to a middle portion 134 having four raised ribs 135 on opposite front and back sides of the grip that form grooves in between for placement of a user's fingers during use of the hammer 100. For example, generally, a user can place their index finger in the groove formed below the top rib 135 and the remaining fingers in the grooves below and the user's thumb can be placed above the top rib 135 and curl around the grip 130. The middle portion 134 of the hammer is connected to an end portion 136 with an outwardly tapering bottom portion and a rounded end 137, the grip 130 further including a cap portion 138 attached to a top end of the upper portion of the grip and the cap portion 138 including a bottom portion 139 of the cap portion 138 extending upwardly away from and substantially parallel to the upper portion of the grip and a top portion 140 of the cap extending diagonally inwardly from the bottom portion 139 toward and affixing to the handle 120.

Figure 7:
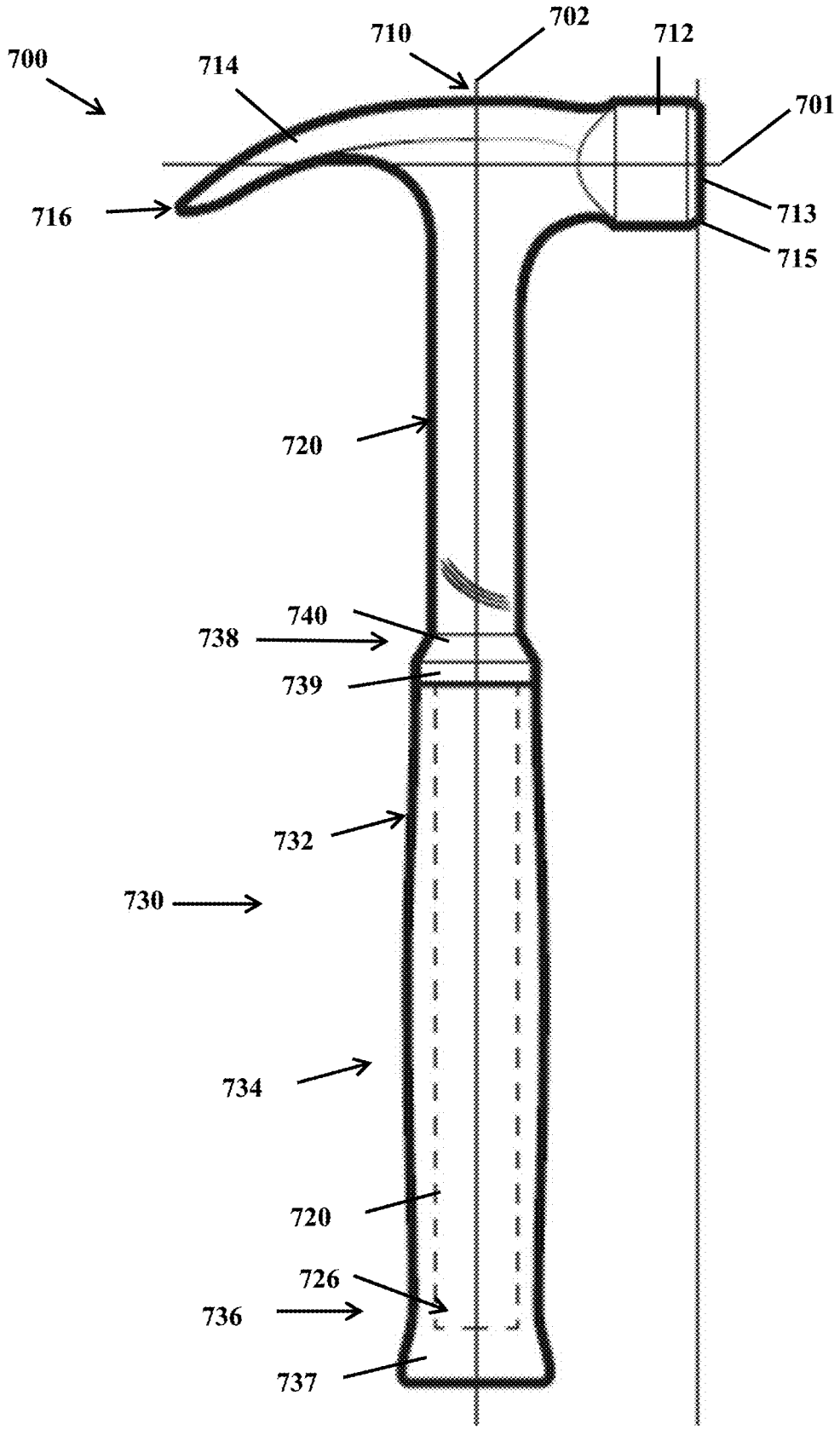
FIG. 7 is a right side view of a roofing and nail removal hammer with a smooth grip, in accordance with another embodiment of the present invention.

Although not shown in FIG. 1, in other embodiments of the hammer, a non-ribbed, smooth handle, such as shown and described in and in relation to FIG. 7 herein, can also be used. Similarly, embodiments of the hammer 100 can include non-contiguously/non-integrally molded handles, which can be made to be replaceable.

Figure 2:
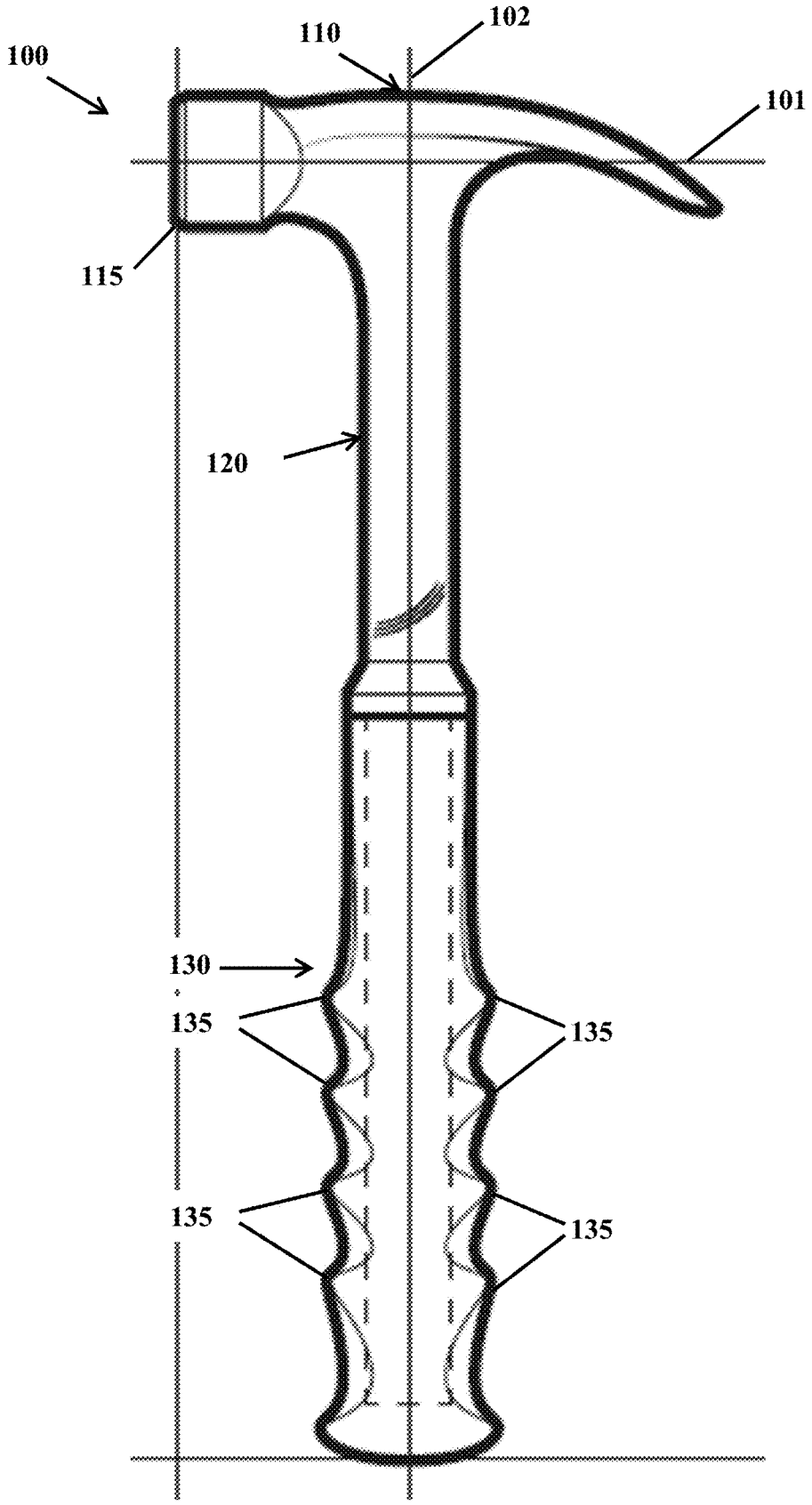
FIG. 2 is a left side view of the roofing and nail removal hammer with ribbed grip of FIG. 1, in accordance with an embodiment of the present invention.

FIG. 2 is a left side view of the roofing and nail removal hammer with ribbed grip of FIG. 1, in accordance with an embodiment of the present invention. In FIG. 2, it can be seen that the ribs 135 and finger grooves that they form extend completely around the grip 130.

Figure 3:
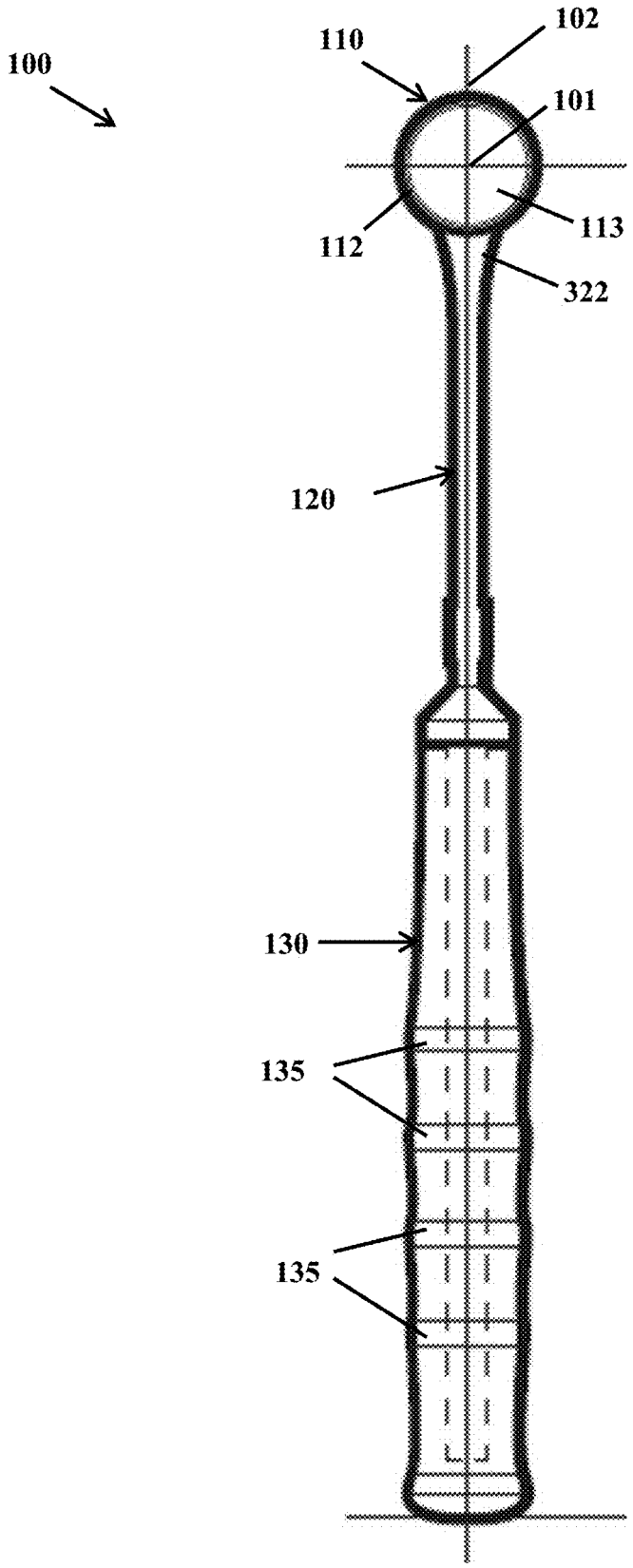
FIG. 3 is a front view of the roofing and nail removal hammer with ribbed grip of FIG. 1, in accordance with an embodiment of the present invention.

FIG. 3 is a front view of the roofing and nail removal hammer with ribbed grip of FIG. 1, in accordance with an embodiment of the present invention. In FIG. 3, the face 113 of the hammer 100 is seen to be substantially flat and smooth with the longitudinal axis 101 that extends from a center point in the face rearward through the head. The grip 130 ribs 135 are seen extending around the front of the grip 130. Also, a top end 322 of the handle 120 angles outwardly from the handle toward and merges into a bottom side of the head 110.

Figure 4:
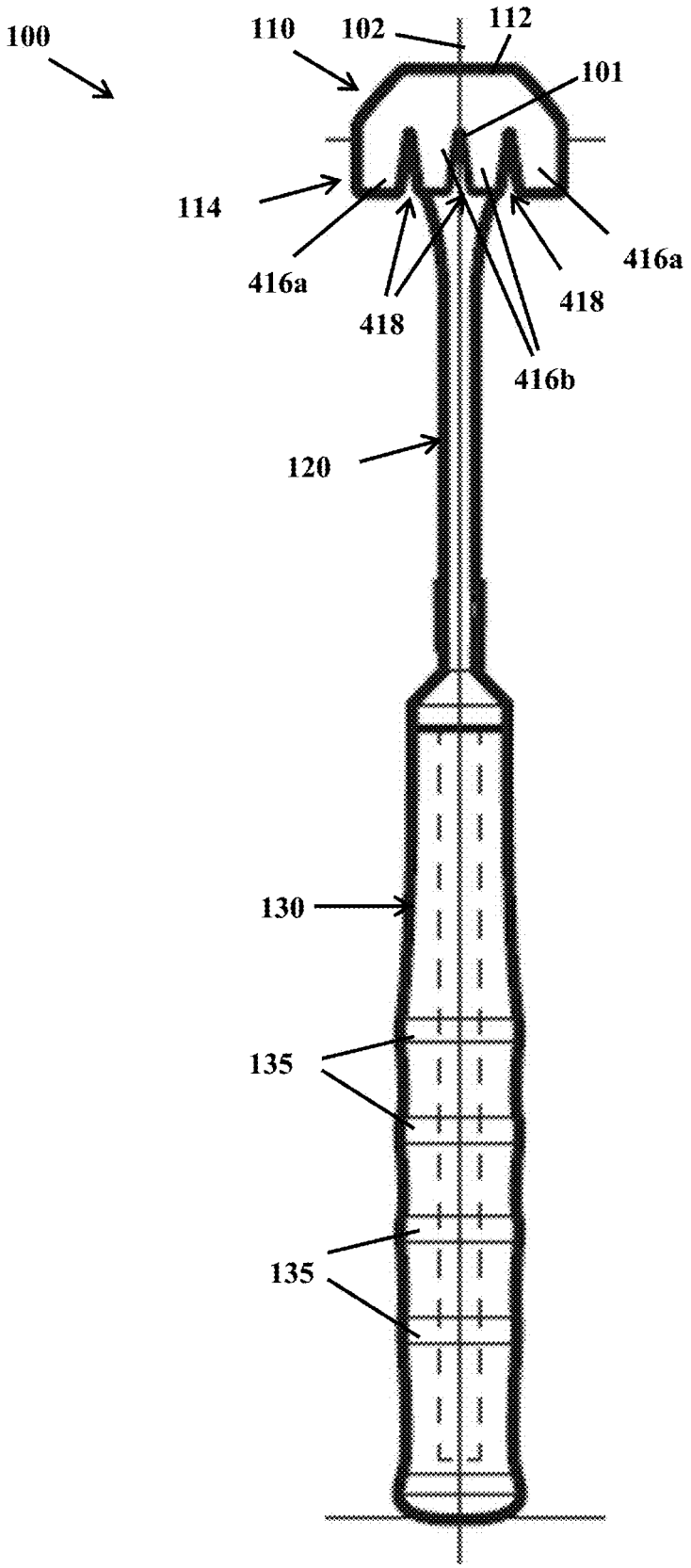
FIG. 4 is a back view of the roofing and nail removal hammer with ribbed grip of FIG. 1, in accordance with an embodiment of the present invention.

FIG. 4 is a back view of the roofing and nail removal hammer with ribbed grip of FIG. 1, in accordance with an embodiment of the present invention. In FIG. 4, the claw portion 114 of the hammer 100 is seen to include four teeth elements, two substantially equally sized outer teeth 416*a* and two substantially equally sized inner teeth 416*b* with three substantially equally sized "V"-shaped grooves 418 between inner teeth 416*a* and outer teeth 416*b* with a central one of the grooves 418 being aligned with the vertical axis 102. In general, the inner teeth 416*a* and the outer teeth 416*b* have blunt/flat ends, but each tooth tapers down toward the end, as can the inner edges of each of the "V"-shaped grooves 418, to aid in placing the teeth beneath and lifting nail heads in a substrate such as, for example, wood. In embodiments of the present invention the "V"-shaped grooves 418 are about ¾ to 1 inch (¾" to 1) deep, with about a 3/16 to ¼ inch wide top end of the "V"-shaped groove and substantially equally spaced apart by the inner teeth 416*b*. This permits an opening wide enough to capture even the widest diameter common nail shaft, the 16*d*, which has a diameter on the order of about 0.162" and then quickly engage the nail shaft against inside walls of the "V"-shaped groove 418 for pulling. In contrast, most standard hammers have a single 1½ to 1¾+ inches deep groove that can only pull a single nail at a time and that requires the nail be placed 50 to 75+% or more (i.e., ½ to ¾ or more inches) further back in the groove before it can be pulled by the hammer. In the present embodiment, not one, but up to three nails can be simultaneously gripped and then pulled by traveling no more than 1" into one of the grooves 418, depending on the size and diameter of the nail. As a result, embodiments of the present invention are designed to quickly engage and simultaneously pull multiple nails from existing constructions, including, for example, but not limited to, roofing, flooring, walls, etc. The outer teeth are of a slightly larger size and configuration than the inner teeth for added strength and durability. For example, the outer teeth 416*a* are approximately ⅜" wide and the inner teeth 416*b* are approximately ¼' outer teeth 416*a* are about 50% wider than the inner teeth 416*b*. The grip 130 ribs 135 are seen extending around the back of the grip 130. The outer teeth 416*a* are slightly larger than the inner teeth 416*b* to provide addition strength to each of the outer teeth 416*a* to prevent breakage during use, e.g., removal of shingles, multiple nails, removal of wood paneling, removal of subflooring, etc.

Figure 5:
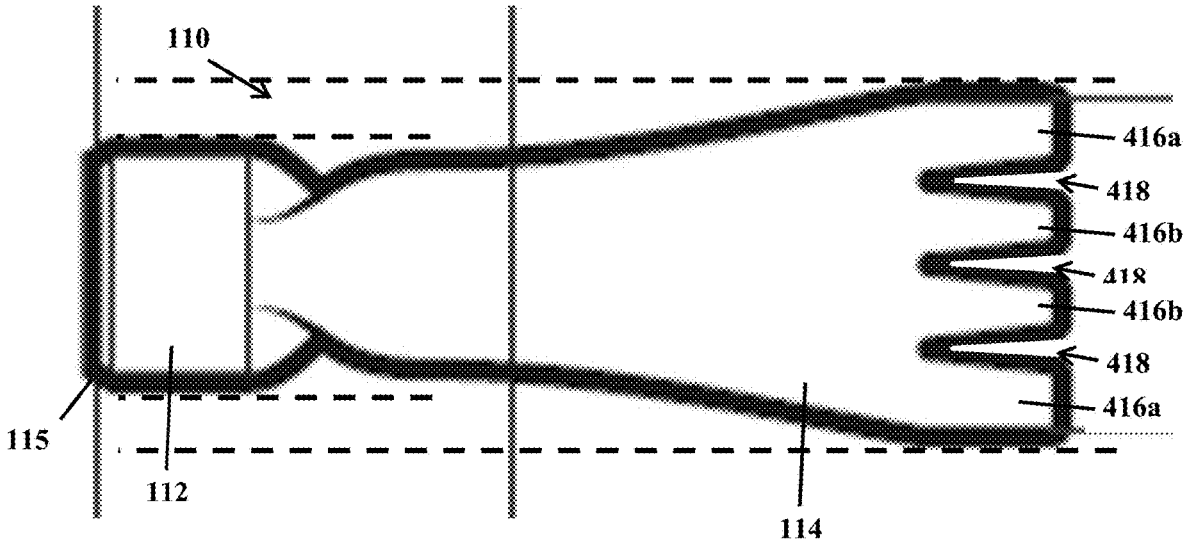
FIG. 5 is a top view of the roofing and nail removal hammer with ribbed grip of FIG. 1, in accordance with an embodiment of the present invention.

FIG. 5 is a top view of the roofing and nail removal hammer with ribbed grip of FIG. 1, in accordance with an embodiment of the present invention. In FIG. 5, the head 110 of the hammer 100 is seen with a maximum width of the end 116 of the claw portion 114 being wider than a width of the hammering portion 112. In fact, the claw portion 114 is approximately between ⅓ to ½ times wider than the hammering portion 112. In the four tooth embodiments of the present invention, the outer width of the claw portion is approximately 2 inches.

Figure 6:
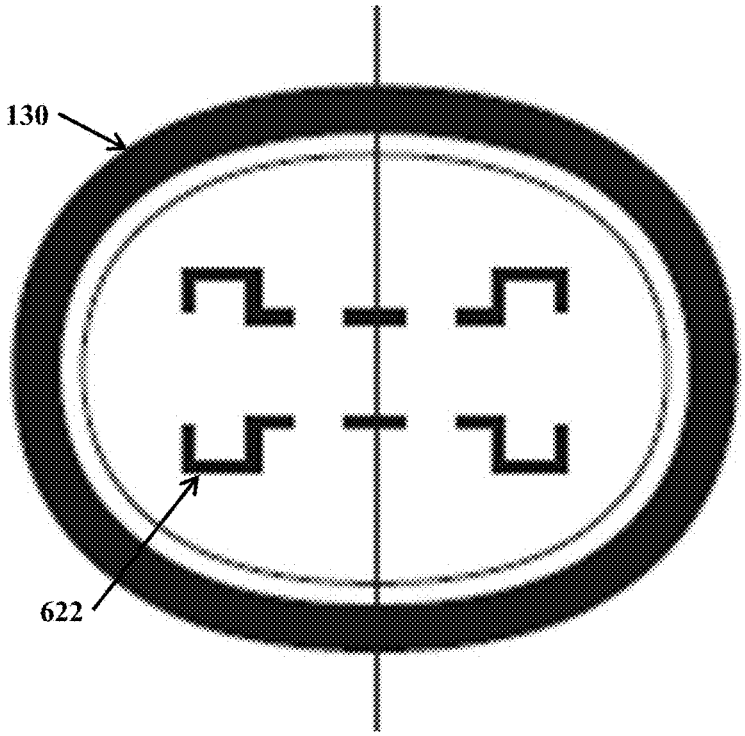
FIG. 6 is a bottom view of the roofing and nail removal hammer with ribbed grip of FIG. 1, in accordance with an embodiment of the present invention.

FIG. 6 is a bottom view of the roofing and nail removal hammer with ribbed grip of FIG. 1, in accordance with an embodiment of the present invention. In FIG. 6, an "I"-shaped end section 622 of the handle 120 is shown in dashed line within the grip 130. The "I"-shaped end section 622 provides additional support and strength to the handle 120.

FIG. 7 is a right side view of a roofing and nail removal hammer with a smooth grip, in accordance with an embodiment of the present invention. In FIG. 7, a hammer 700, which is similar to the hammer 100 described above in FIG. 1 and as such includes similar properties and features described above in regard to FIG. 1 with the additions noted herein. In FIG. 7, is shown to include a head 710 with a longitudinal axis 701, a hammering portion 712 and an oppositely arranged claw portion 714, the claw portion 714 including a back end 716 with at least four teeth separated by at least three, substantially equal "V"-shaped grooves centered on the longitudinal axis 701 of the head. The hammering portion 712 includes a face 713, which is shown to be substantially flat and smooth, but in other embodiments the face 713 may be slightly convex, rounded and/or flat and with and without a checkered pattern. A beveled or chamfered edge 715 tapers inwardly from an outer surface of the hammering portion 712 towards and connects to and around an outer circumference of the face 713. The hammer further includes a handle 720 formed contiguously with the head 710 and extending perpendicularly down and away from a bottom side of the head 710 with a vertical axis 702 that is perpendicular to the longitudinal axis 701 of the head. The hammer still further includes a grip 730 affixed to and surrounding a bottom portion of the handle 720 from approximately above a middle of the handle 720 to below and surrounding a bottom end 726 of the handle 720, the grip 730 includes a downwardly and outwardly tapering upper portion 732 connected to a wider middle portion 734 having a smooth surface. The middle portion 734 of the hammer is connected to an end portion 736 with an outwardly tapering bottom portion and a flat end 737, the grip 730 further includes a cap portion 738 attached to a top end of the upper portion of the grip and the cap portion 738 includes a bottom portion 739 of the cap portion 738 extending upwardly away from and substantially parallel to the upper portion of the grip and a top portion 740 of the cap extending diagonally inwardly from the bottom portion 739 toward and affixing to the handle 720.

Figure 8:
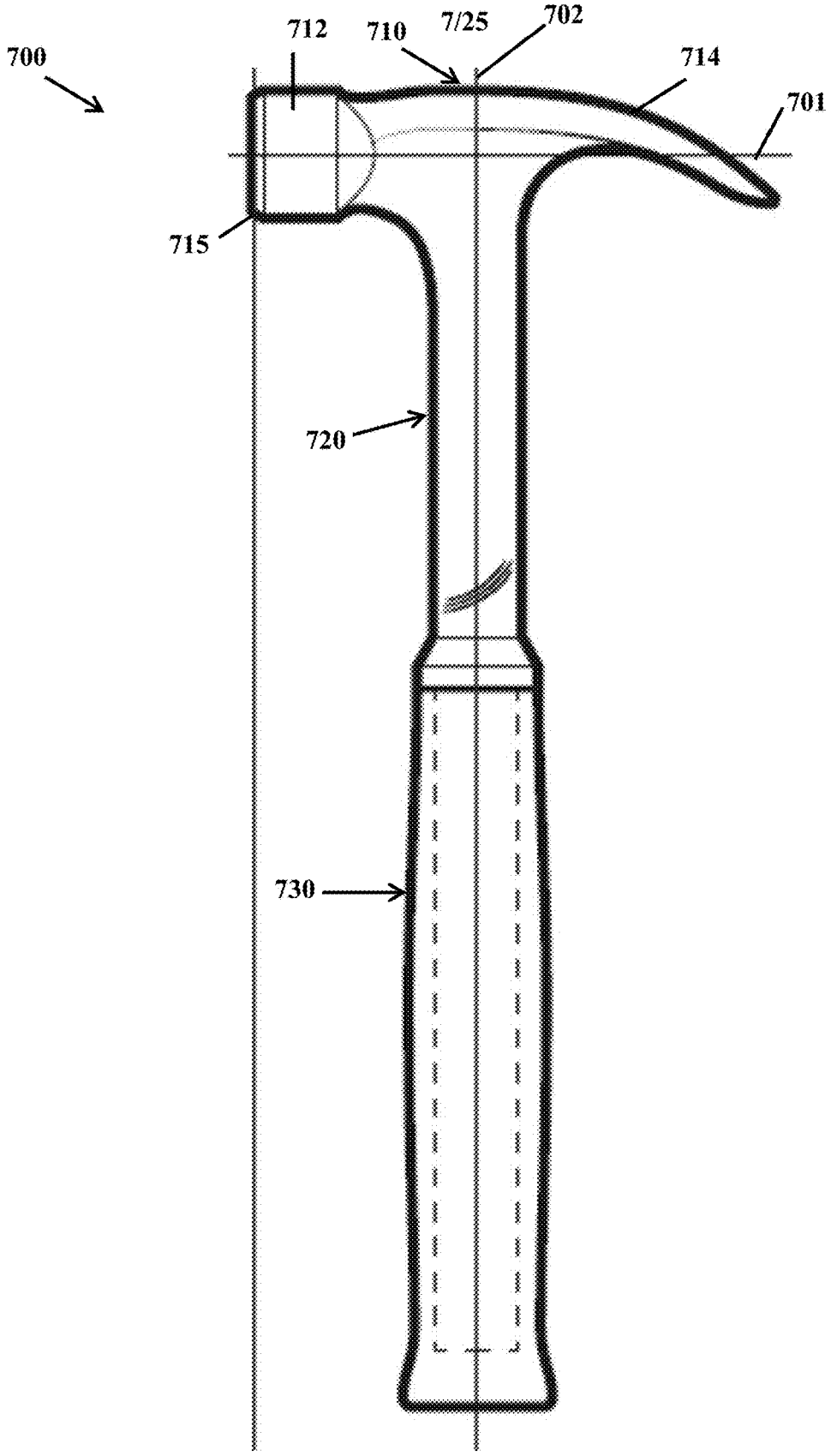
FIG. 8 is a left side view of the roofing and nail removal hammer with smooth grip of FIG. 7, in accordance with another embodiment of the present invention.

FIG. 8 is a left side view of the roofing and nail removal hammer with smooth grip of FIG. 7, in accordance with another embodiment of the present invention. In FIG. 8, it can be seen that grip 730 has a smooth surface that extends completely around the grip 730.

Figure 9:
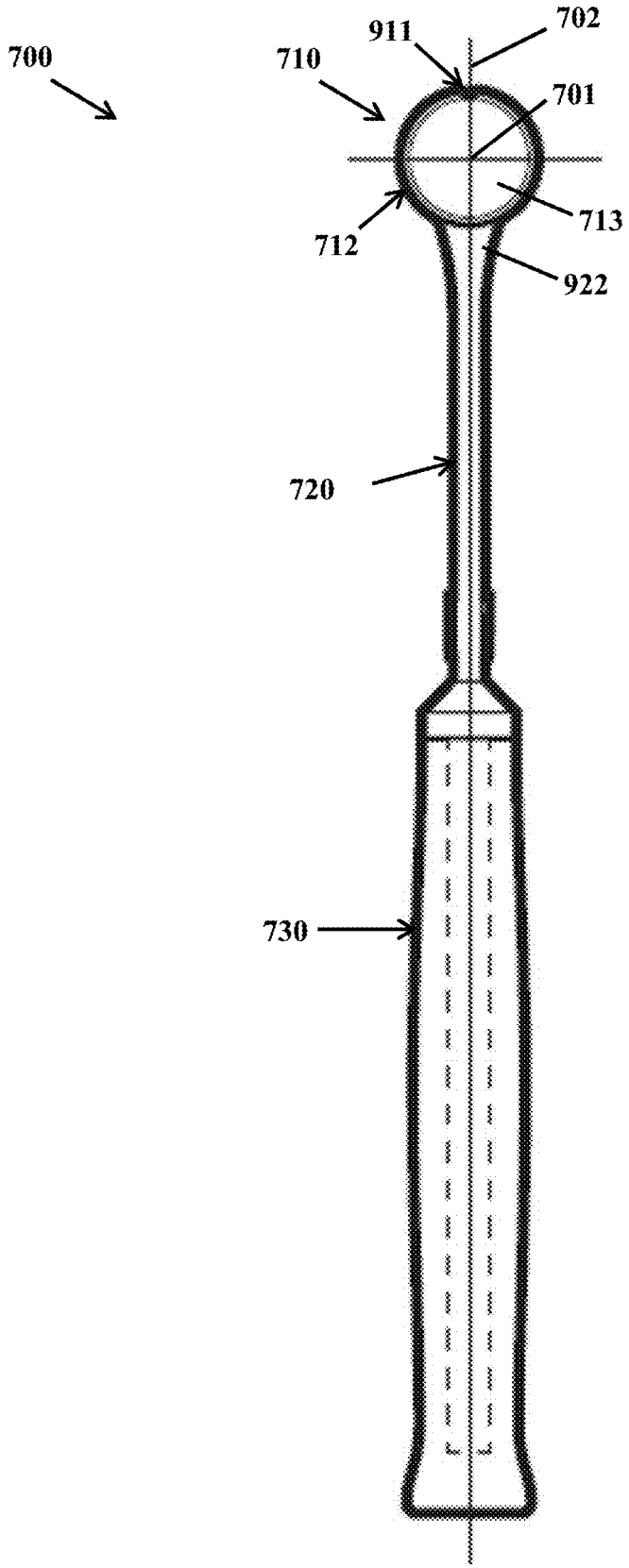
FIG. 9 is a front view of the roofing and nail removal hammer with smooth grip of FIG. 7, in accordance with another embodiment of the present invention.

FIG. 9 is a front view of the roofing and nail removal hammer with smooth grip of FIG. 7, in accordance with another embodiment of the present invention. In FIG. 9, the face 713 of the hammer 700 is seen to be substantially flat and smooth with the longitudinal axis 701 extends from a center point in the face rearward through the head. On top of the hammering portion 712 is a nail groove 911 that extends rearwardly from adjacent the face 713 toward the claw portion 714, parallel to the longitudinal axis 701 and perpendicular to the vertical axis 702. Also, a top end 922 of the handle 720 angles outwardly from the handle toward and merges in to a bottom side of the head 710.

Figure 10:
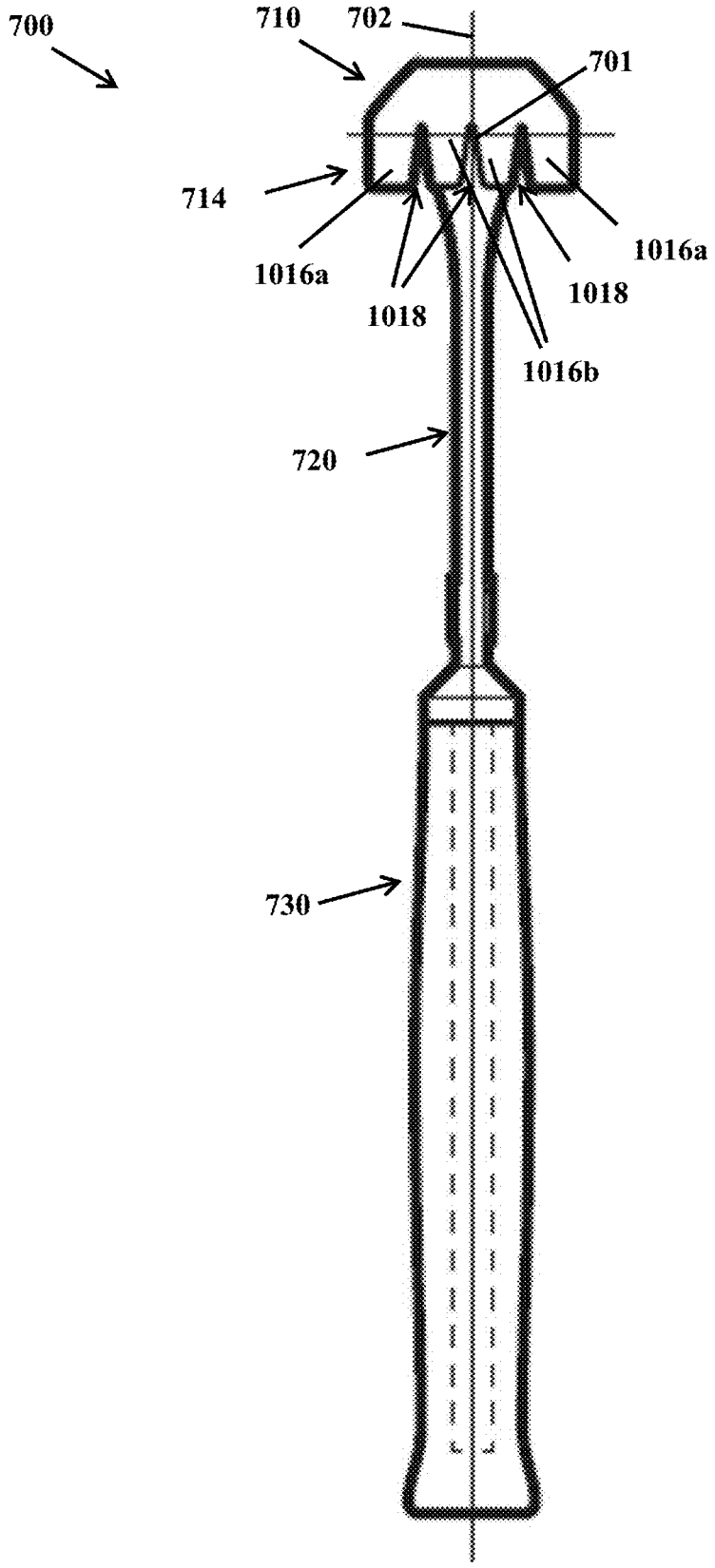
FIG. 10 is a back view of the roofing and nail removal hammer with smooth grip of FIG. 7, in accordance with another embodiment of the present invention.

FIG. 10 is a back view of the roofing and nail removal hammer with smooth grip of FIG. 7, in accordance with another embodiment of the present invention. In FIG. 10, the claw portion 714 of the hammer 700 is seen to include four teeth elements, two substantially equally sized outer teeth 1016*a* and two substantially equally sized inner teeth 1016*b* with three substantially equally sized "V"-shaped grooves 1018 between the teeth 1016*a*, 1016*b* with a central one of the grooves 1018 being aligned with the vertical axis 702. The outer teeth 1016*a* are slightly larger than the inner teeth 1016*b* to provide additional strength to each of the outer teeth 1016*a* to prevent breakage during use, e.g., removal of shingles, multiple nails, removal of wood paneling, removal of subflooring, etc.

Figure 11:
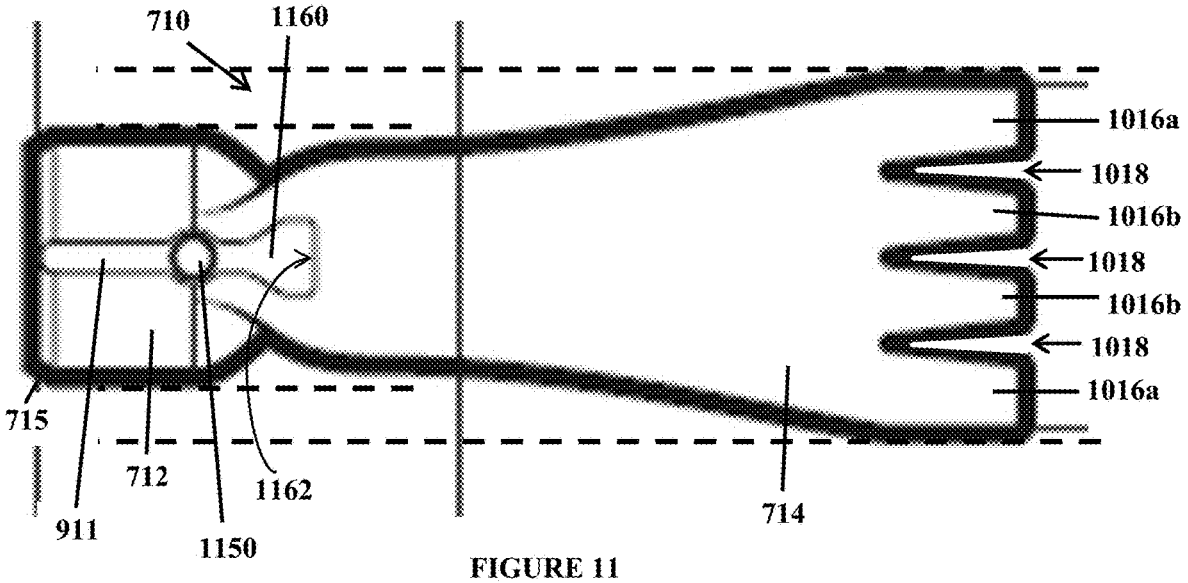
FIG. 11 is a top view of the roofing and nail removal hammer with smooth grip of FIG. 7, in accordance with another embodiment of the present invention.

FIG. 11 is a top view of the roofing and nail removal hammer with smooth grip of FIG. 7, in accordance with another embodiment of the present invention. In FIG. 11, the head 710 of the hammer 700 is seen with a maximum width of the end 716 of the claw portion 714 being wider than a width of the hammering portion 712. In fact, the claw portion 714 is approximately between ⅓ to ½ times wider than the hammering portion 712. In this embodiment, the head portion 712 includes the nail groove 911 that extends from adjacent the face 713 and rearwardly along a top side of the hammering portion 712 toward and onto the front end of the claw portion 714. The nail groove 911 has a substantially semicircular first section in which is embedded in a bottom of the nail groove 911 a magnet 1150 to hold a nail for initial nailing. At an inside end of the nail groove 911 is an expanded opening 1160, which resembles a cross-sectional view of a top portion of a golf tee top and is configured to receive a nail head ranging from a common nail head shape to a finish nail head. An end wall of the expanded opening 1162 is configured to have a top of a nail head abut against it to permit an initial driving and/or application of the nail into a board or other substrate without a user of the hammer 700 having to hold the nail.

Figure 12:
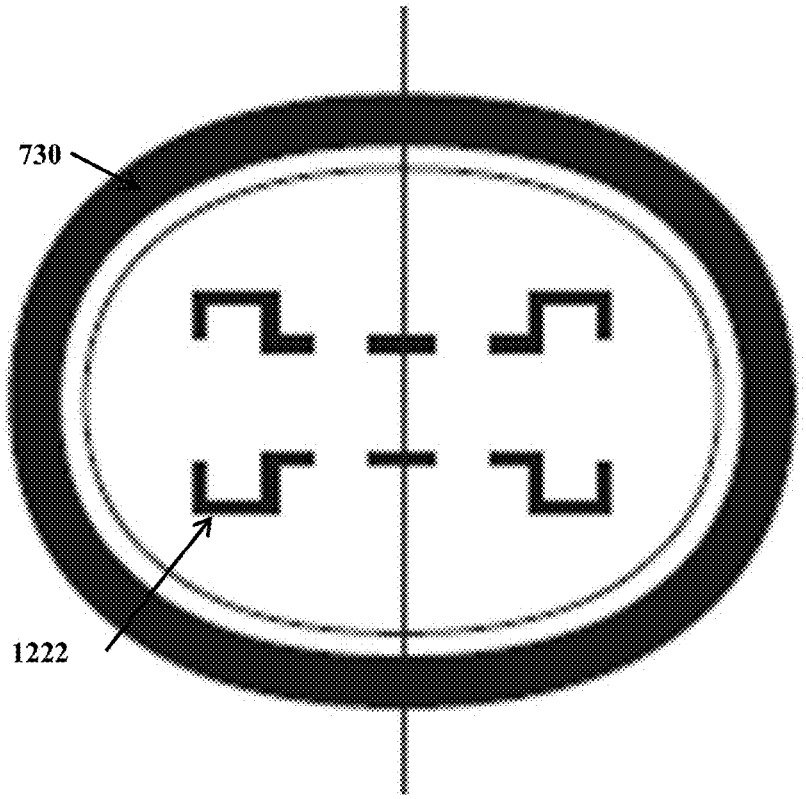
FIG. 12 is a bottom view of the roofing and nail removal hammer with smooth grip of FIG. 7, in accordance with another embodiment of the present invention.

FIG. 12 is a bottom view of the roofing and nail removal hammer with smooth grip of FIG. 7, in accordance with another embodiment of the present invention. In FIG. 12, an "I"-shaped end cross-section 1222 of the handle 720 is shown in dashed line within the grip 730. The "I"-shape 1222 of the handle 720 provides additional support and strength to the handle 720.

Figure 13:
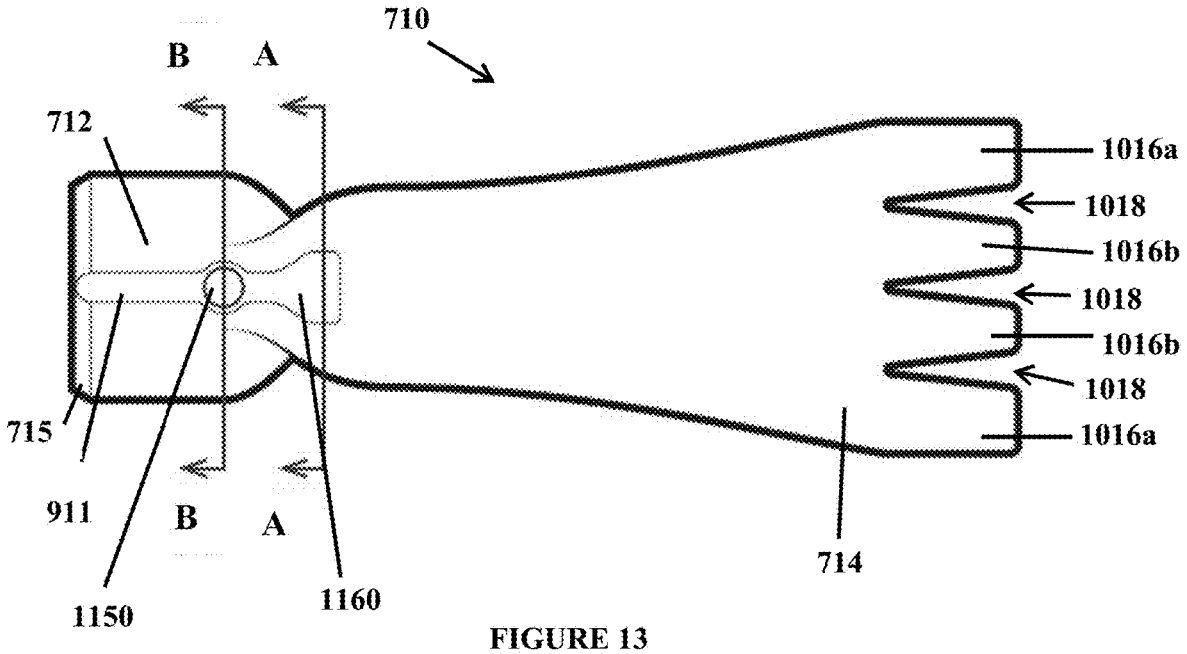
FIG. 13 is close up view of the top of the roofing and nail removal hammer of FIG. 11, in accordance with another embodiment of the present invention.

FIG. 13 is close up view of the top of the roofing and nail removal hammer of FIG. 11, in accordance with another embodiment of the present invention. In FIG. 13, two cross-section lines A-A and B-B are shown across groove 911.

Figure 14:
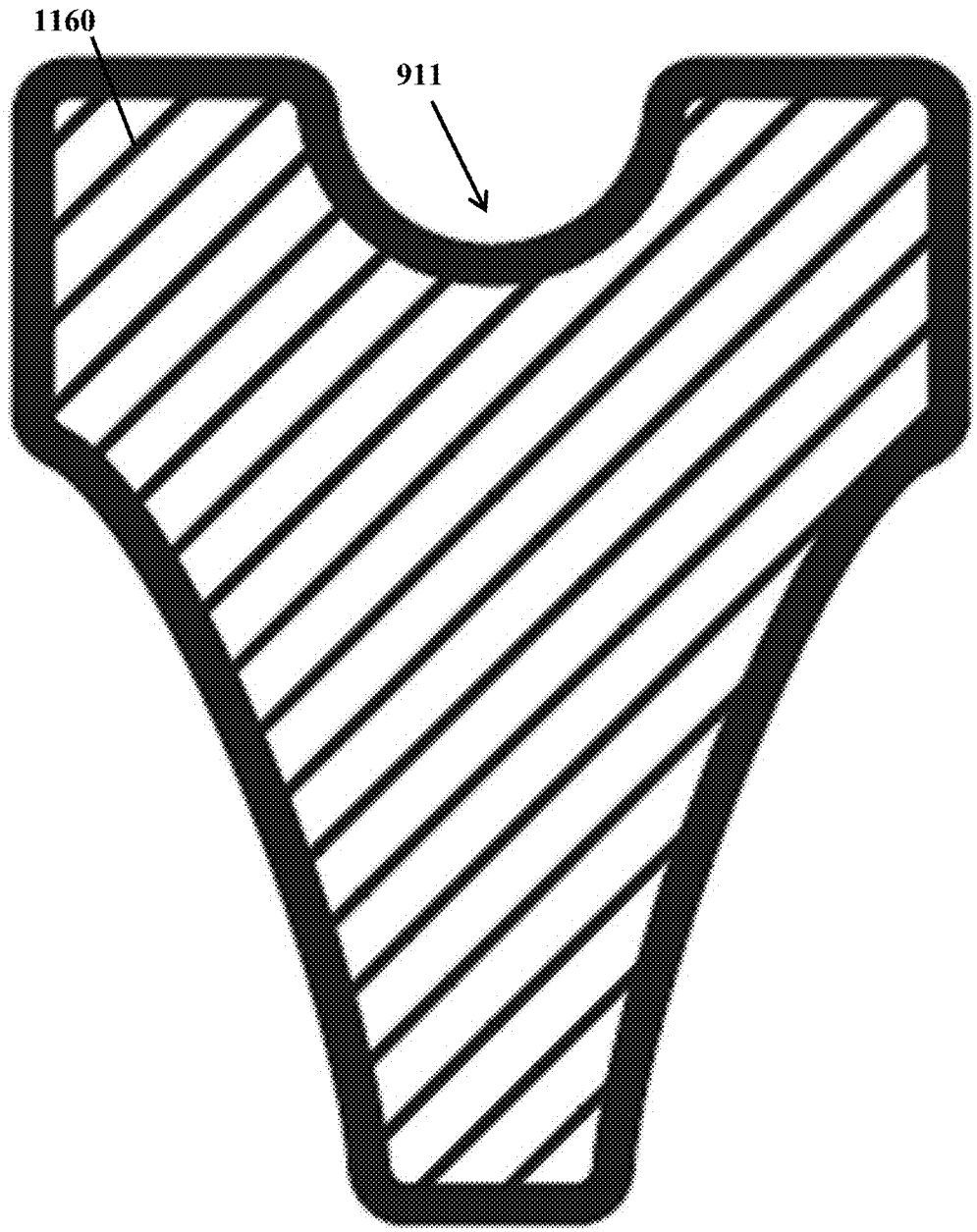
FIG. 14 is a cross-sectional view of the top of the roofing and nail removal hammer along line A-A of FIG. 13 showing the nail groove in the top of the hammer head, in accordance with another embodiment of the present invention.

FIG. 14 is a cross-sectional view of the top of the roofing and nail removal hammer along line A-A of FIG. 13 showing the nail groove in the top of the hammer head, in accordance with another embodiment of the present invention. In FIG. 14, the cross-sectional configuration of the expanded opening 1160 and the groove 911 are seen looking from the front end of the claw portion 714 toward the face 713 of the hammering portion 712. The substantially semicircular first section of groove 911 is clearly seen in the cross-section of FIG. 14.

Figure 15:
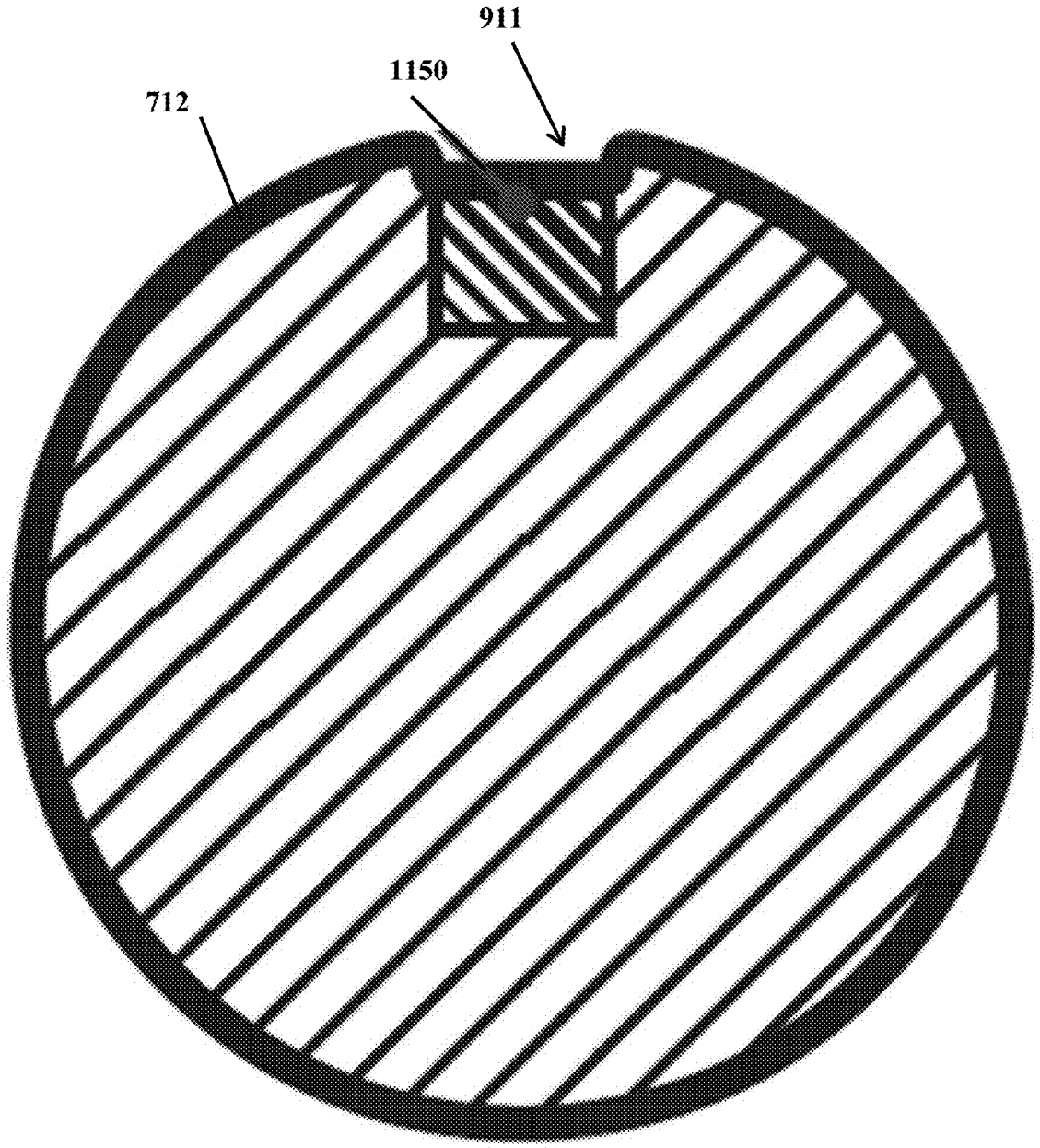
FIG. 15 is a cross-sectional view of the top of the roofing and nail removal hammer along line B-B of FIG. 13 showing the nail groove and magnet in the top of the hammer head, in accordance with another embodiment of the present invention.

FIG. 15 is a cross-sectional view of the top of the roofing and nail removal hammer along line B-B of FIG. 13 showing the nail groove and magnet in the top of the hammer head, in accordance with another embodiment of the present invention. In FIG. 15, the nail groove 911 is shown in cross-section with the magnet 1150 embedded in the hammering portion 712 in and below a bottom of the nail groove 911. The magnet 1150 holds a nail within the nail groove 911 and a head of the nail rests inside of and against a back surface of the expanded opening 1160 to permit an initial application of the nail to a board without the user having to hold the nail in his/her other hand. Although shown to have a substantially flat top surface, the magnet 1150 can also have a concave top shape that is substantially the same shape as the nail groove 911.

Figure 16:
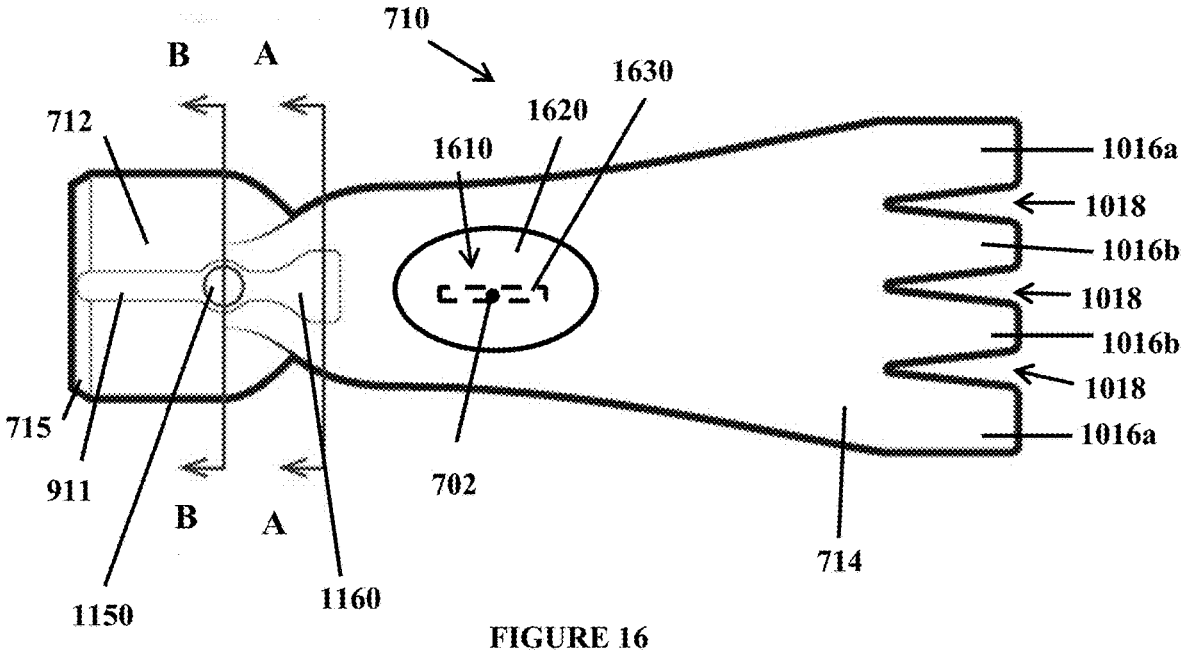
FIG. 16 is a top view of a roofing and nail removal hammer head similar to that in FIG. 13; however, in FIG. 16 the head is configured to be used with non-integrally formed handles made of the same as well as different materials than the head, in accordance with another embodiment of the present invention.

FIG. 16 is a top view of a roofing and nail removal hammer head similar to that in FIG. 13, however, in FIG. 16, the head is configured to be used with non-integrally formed handles made of the same as well as different materials than the head, in accordance with another embodiment of the present invention. In FIG. 16, an opening 1610 is seen formed in the head 710 and centered on the vertical axis 702. Although the shape is shown to be oval, any shape can be used depending on the configuration of a top of a handle 1620 to be attached to the head. This style is often used with wood handles to permit the insertion of an optional wood or metal wedge 1630 (shown in dashed line) into the top of the handle 1620 to attach the top of the handle 1620 to the head 710. For non-wood and non-metal handles, for example, fiberglass, etc., a wedge 1630 is not required, but the opening 1610 can still be used to permit the introduction of the fiberglass, etc. through the head and into a handle mold. In addition, other embodiments can include a head without any top opening, as seen in FIG. 13, but with the same base configuration shown and/or described below in FIGS. 17 to 19. These embodiments permit separate manufacturing processes for the head and handles as well as enable the use of different materials for the two. Also, these designs can permit the replacement of the handles, for example, if one is broken or a different style of handle is desired by the user.

Figure 17:
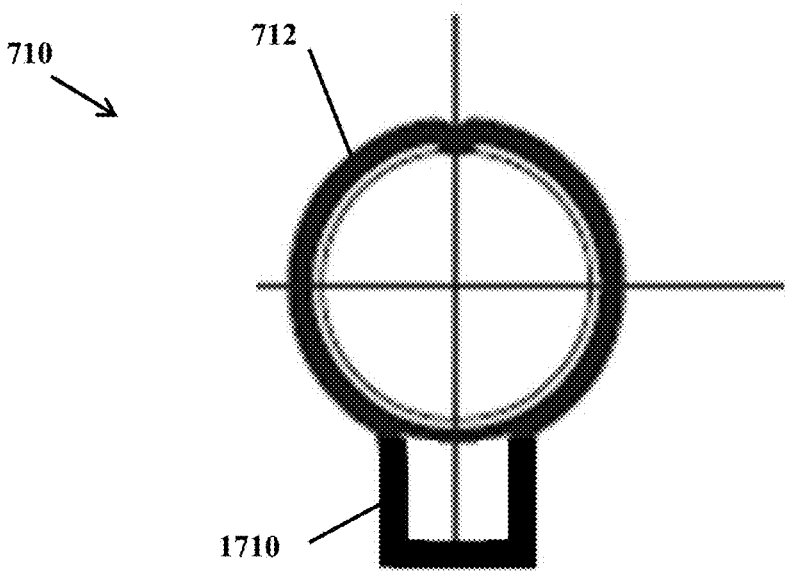
FIG. 17 is a front view of the roofing and nail removal hammer head of FIG. 16, in accordance with another embodiment of the present invention.

FIG. 17 is a front view of the roofing and nail removal hammer head of FIG. 16, in accordance with another embodiment of the present invention. In FIG. 17, a base 1710 is shown below the hammering portion 712 of the head 710. Although the base 1710 is shown to have a substantially square front end, other embodiments are contemplated in which the base 1710 can have other configurations, for example, but not limited to, an oval, a circular, or a square shape. In this embodiment, the top of the handle is either wedged, affixed, glued or otherwise adhered against an inside of the base 1710 during manufacturing of the finished hammer. Different levels of adhesion between the top of the handle and the inside of the base, will determine the ease with which the handle can be replaced. For example, a wood handle with just a wedge is likely the easiest to replace, while a poured and/or an adhered handle is likely the hardest to replace due to the extra effort needed to remove the handle material and/or adhesive that will have adhered to the inside of the base of the head during manufacturing.

Figure 18:
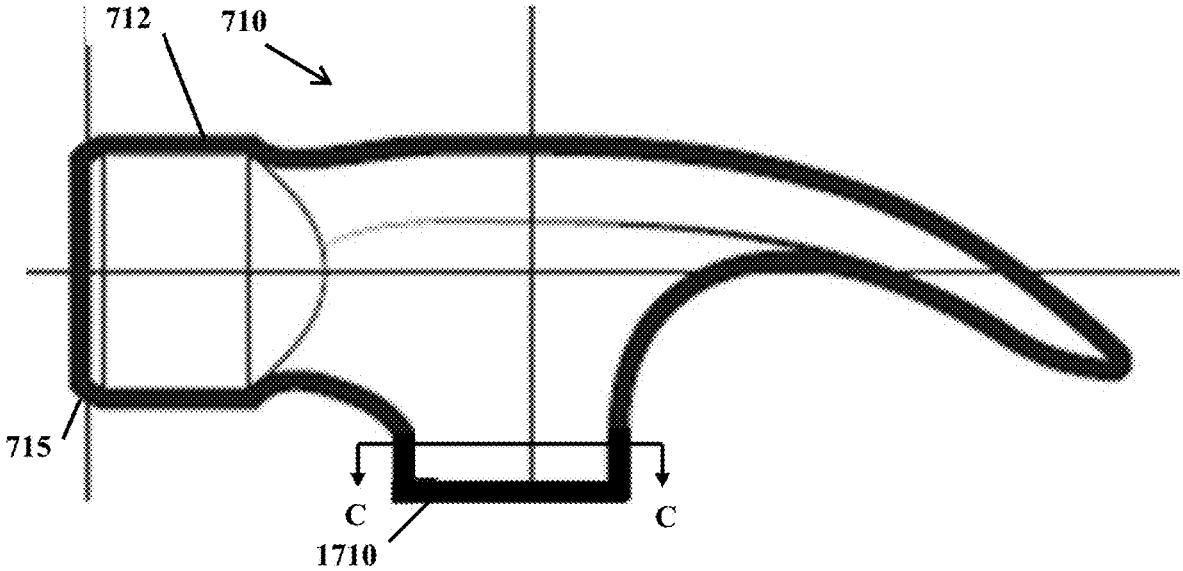
FIG. 18 is a side view of the roofing and nail removal hammer head of FIG. 16, in accordance with another embodiment of the present invention.

FIG. 18 is a side view of the roofing and nail removal hammer head of FIG. 16, in accordance with another embodiment of the present invention. In FIG. 18, a left side of the base 1710 is shown to have a substantially rectangular shape, which is a mirror image of the not shown, opposite right side of the base 1710. A cross-section line C-C is shown across the base 1710.

Figure 19:
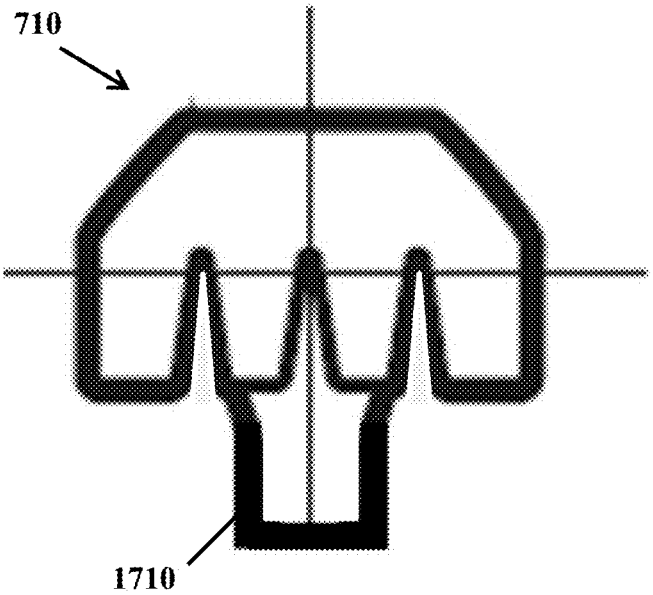
FIG. 19 is a back view of the roofing and nail removal hammer head of FIG. 16, in accordance with another embodiment of the present invention.

FIG. 19 is a back view of the roofing and nail removal hammer head of FIG. 16, in accordance with another embodiment of the present invention.

Figure 20:
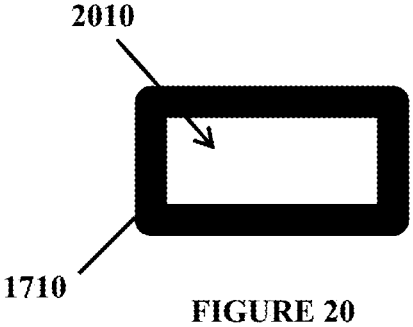
FIG. 20 is a cross-sectional view of the base of the roofing and nail removal hammer head along line C-C of FIG. 18, in accordance with another embodiment of the present invention.

FIG. 20 is a cross-sectional view of the base of the roofing and nail removal hammer head along line C-C of FIG. 18, in accordance with another embodiment of the present invention. As seen in FIG. 20, an interior of the base 1710 has relatively thick walls for strength and an internal opening 2010 formed between the walls with a substantially rectangular shape. Other embodiments are contemplated in which the internal opening 2010 can be oval, circular and/or square and, mainly for the poured handles, with or without ribs, ridges and/or undulations on one or more inside walls of the base 1710, which will provide for a more secure and permanent connection between the handle and the head. However, this also makes it more difficult to replace one of these handles should the need arise.

Figure 21:
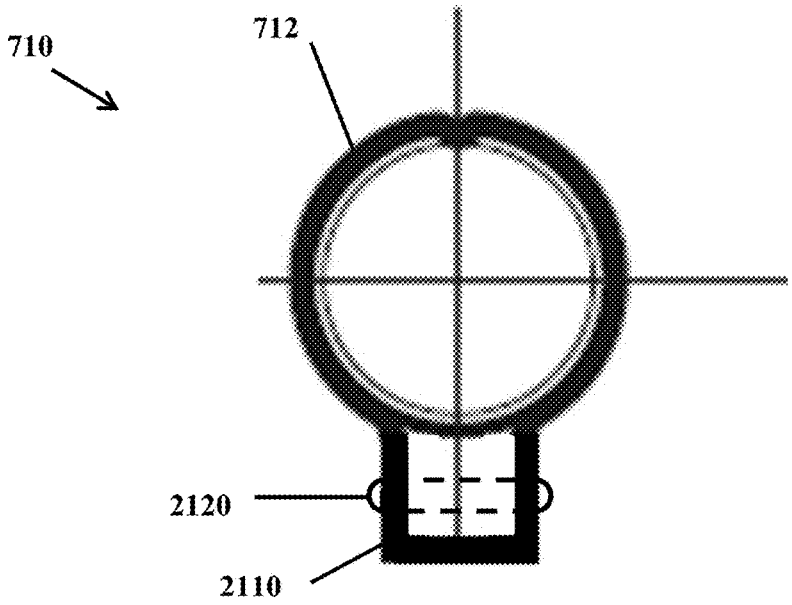
FIG. 21 is a front view of the roofing and nail removal hammer head of FIG. 18, in accordance with another embodiment of the present invention.

FIG. 21 is a front view of the roofing and nail removal hammer head of FIG. 18, in accordance with another embodiment of the present invention. In FIG. 21, a base 2110 is shown below the hammering portion 712 of the head 710. Although the base 2110 is shown to have a substantially square front end, other embodiments are contemplated in which the base 2110 can have other configurations, for example, but not limited to, an oval, a circular, or a square shape. In this embodiment, the top of the handle is slid into and affixed to the base 2110 using a fastening mechanism 2120 that extends through the left and right sides of the base 2110 and the handle portion within the base 210. The fastening mechanism 2120 can include, for example, but not limited to, one or more nuts and bolts, rivets, dowels or pegs, and the like. Although the fastening mechanism 2120 is shown extending past the left and right sides of the base 2110, not all fastening mechanisms 2120 have to extend that far, for example, but not limited to, a dowel or peg can be flush with or even slightly recessed from an outside edge of the base 2110.

Figure 22:
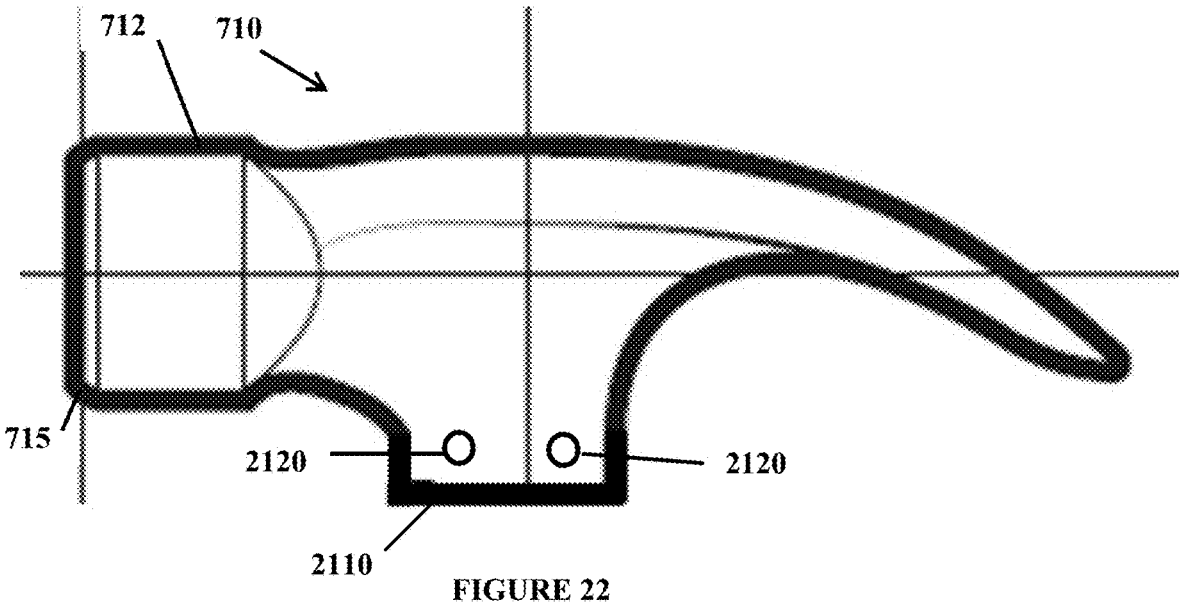
FIG. 22 is a side view of the roofing and nail removal hammer head of FIG. 18, in accordance with another embodiment of the present invention.

FIG. 22 is a side view of the roofing and nail removal hammer head of FIG. 18, in accordance with another embodiment of the present invention. In FIG. 22, a left side of the base 2110 is shown to have a substantially rectangular shape, which is a mirror image of the not-shown, opposite right side of the base 2110, and a front fastening mechanism 2120 and a rear fastening mechanism 2120 passing through the left side wall.

Figure 23:
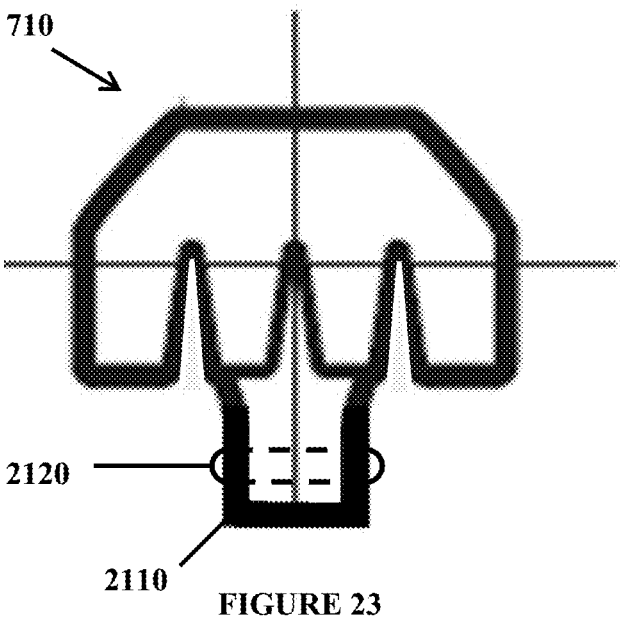
FIG. 23 is a back view of the roofing and nail removal hammer head of FIG. 18, in accordance with another embodiment of the present invention.

FIG. 23 is a back view of the roofing and nail removal hammer head of FIG. 18, in accordance with another embodiment of the present invention. In FIG. 23, the rear fastening mechanism 2120 is shown extending past each side of the base 2120 and in dashed line through the base 2120. FIG. 20 and the description provided above related thereto are also applicable to the base 2120 design in FIGS. 21-23.

Figure 24:
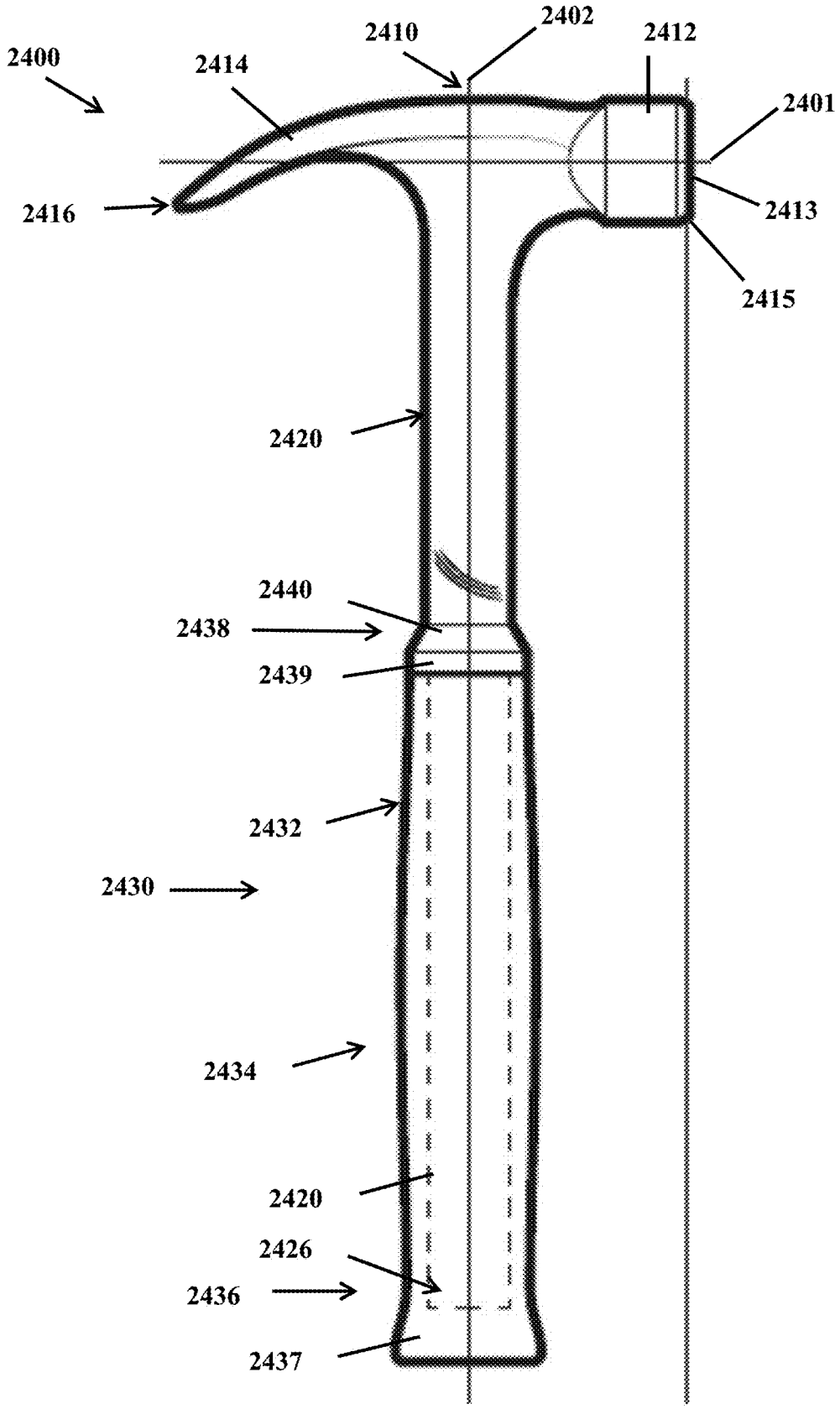
FIG. 24 is a right side view of a roofing and nail removal hammer with a smooth grip, in accordance with another embodiment of the present invention.

FIG. 24 is a right side view of a roofing and nail removal hammer with a smooth grip, in accordance with an embodiment of the present invention. In FIG. 24, a hammer 2400, which is similar to the hammer 100 and 700 described above in FIGS. 1 and 7 and as such includes similar properties and features described above in regard to FIGS. 1 and 7 with the additions noted herein. In FIG. 24, is shown to include a head 2410 with a longitudinal axis 2401, a hammering portion 2412 and an oppositely arranged claw portion 2414, the claw portion 2414 including a back end 2416 with at least three teeth separated by at least two, substantially equal "V"-shaped grooves centered on the longitudinal axis 2401 of the head. The hammering portion 2412 includes a face 2413, which is shown to be substantially flat and smooth, but in other embodiments the face 2413 may be slightly convex, rounded and/or flat and with and without a checkered pattern. A beveled or chamfered edge 2415 tapers inwardly from an outer surface of the hammering portion 712 towards and connects to and around an outer circumference of the face 2413. The hammer further includes a handle 2420 formed contiguously with the head 2410 and extending perpendicularly down and away from a bottom side of the head 2410 with a vertical axis 2402 that is perpendicular to the longitudinal axis 2401 of the head. The hammer still further includes a grip 2430 affixed to and surrounding a bottom portion of the handle 2420 from approximately above a middle of the handle 2420 to below and surrounding a bottom end 2426 of the handle 2420, the grip 2430 includes a downwardly and outwardly tapering upper portion 2432 connected to a wider middle portion 2434 having a smooth surface. The middle portion 2434 of the hammer is connected to an end portion 2436 with an outwardly tapering bottom portion and a flat end 2437, the grip 2430 further includes a cap portion 2438 attached to a top end of the upper portion of the grip and the cap portion 2438 includes a bottom portion 2439 of the cap portion 2438 extending upwardly away from and substantially parallel to the upper portion of the grip and a top portion 2440 of the cap extending diagonally inwardly from the bottom portion 2439 toward and affixing to the handle 2420.

Figure 25:
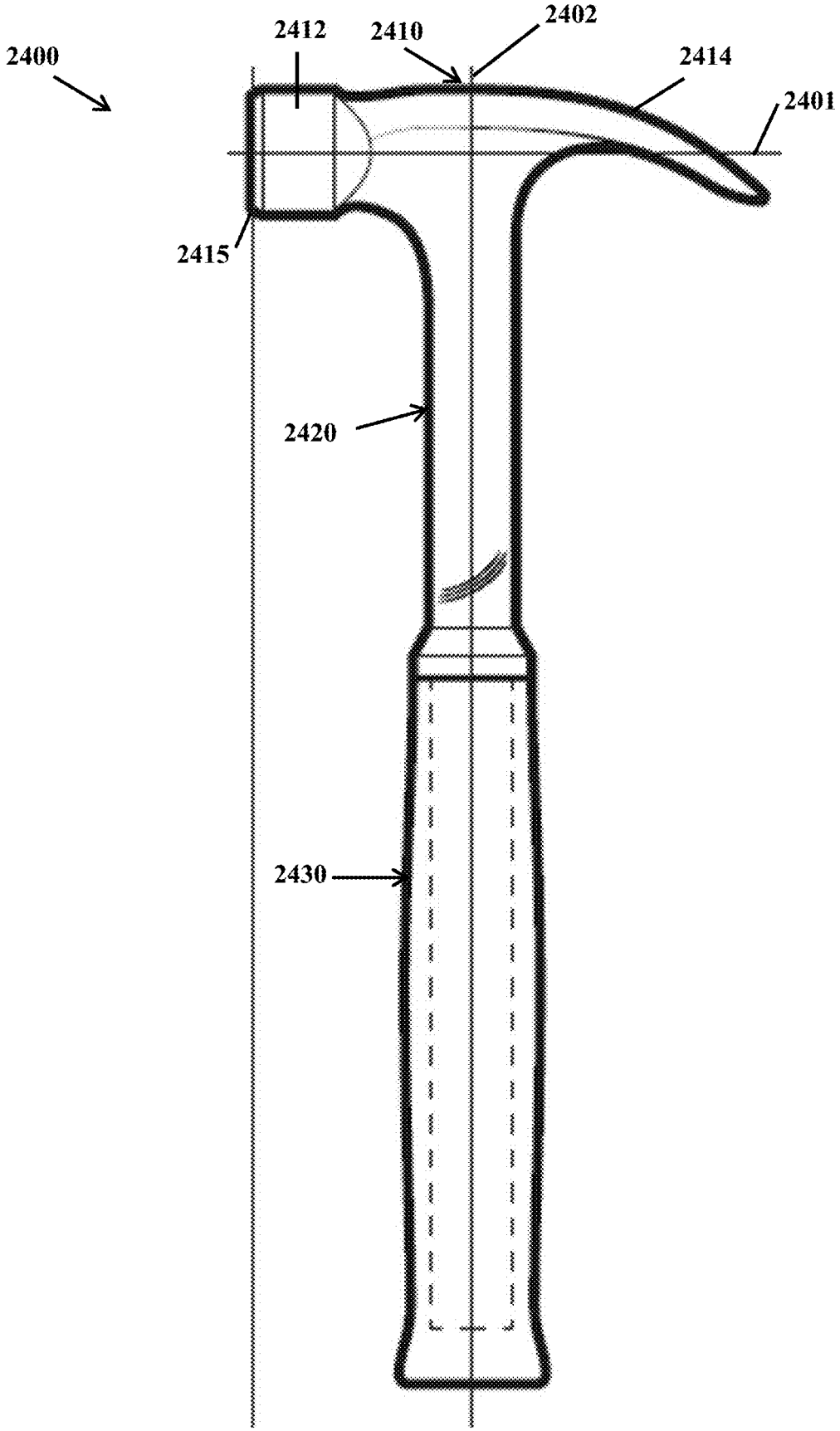
FIG. 25 is a left side view of the roofing and nail removal hammer with smooth grip of FIG. 24, in accordance with another embodiment of the present invention.

FIG. 25 is a left side view of the roofing and nail removal hammer with smooth grip of FIG. 24, in accordance with another embodiment of the present invention. In FIG. 25, it can be seen that grip 2430 has a smooth surface that extends completely around the grip 2430.

Figure 26:
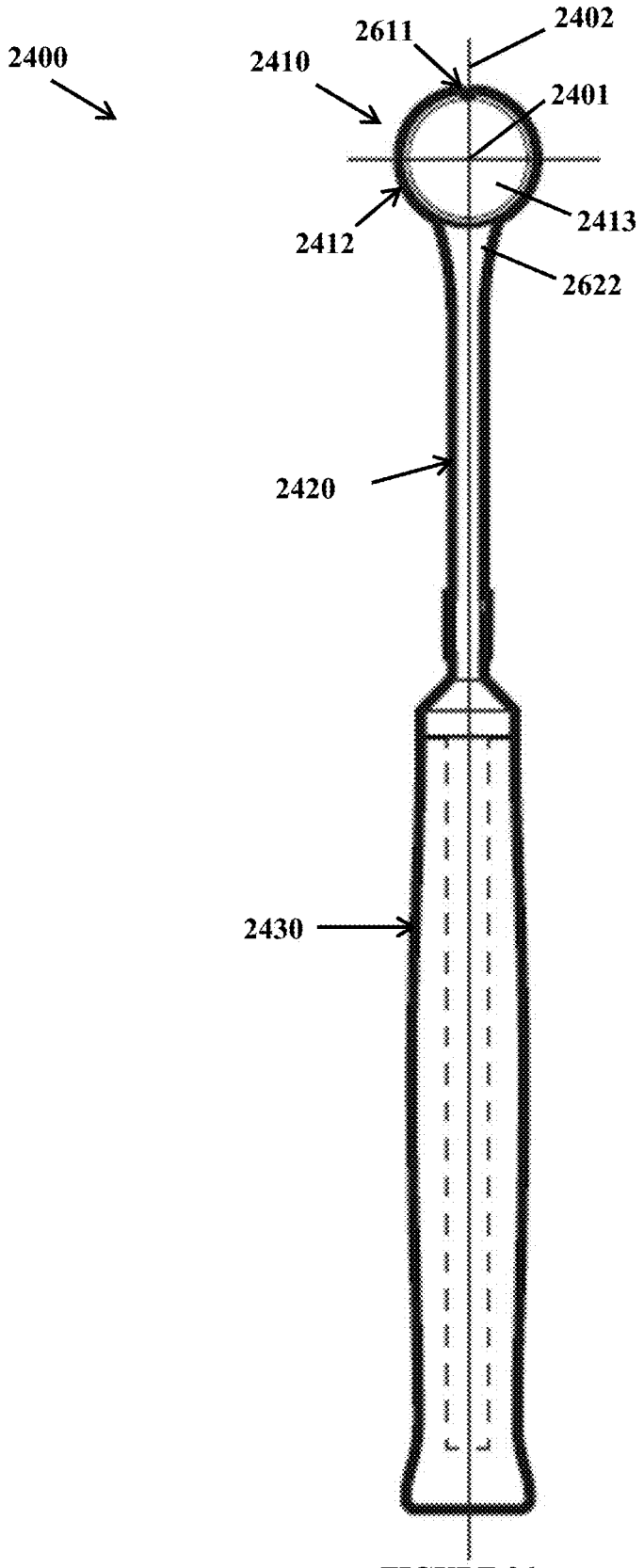
FIG. 26 is a front view of the roofing and nail removal hammer with smooth grip of FIG. 24, in accordance with another embodiment of the present invention.

FIG. 26 is a front view of the roofing and nail removal hammer with smooth grip of FIG. 24, in accordance with another embodiment of the present invention. In FIG. 26, the face 2413 of the hammer 2400 is seen to be substantially flat and smooth with the longitudinal axis 2401 that extends from a center point in the face rearward through the head. On top of the hammering portion 2412 is a nail groove 2611 that extends rearwardly from adjacent the face 2413 toward the claw portion 2414, parallel to the longitudinal axis 2401 and perpendicular to the vertical axis 2402. Also, a top end 2622 of the handle 2420 angles outwardly from the handle toward and merges in to a bottom side of the head 2410.

Figure 27:
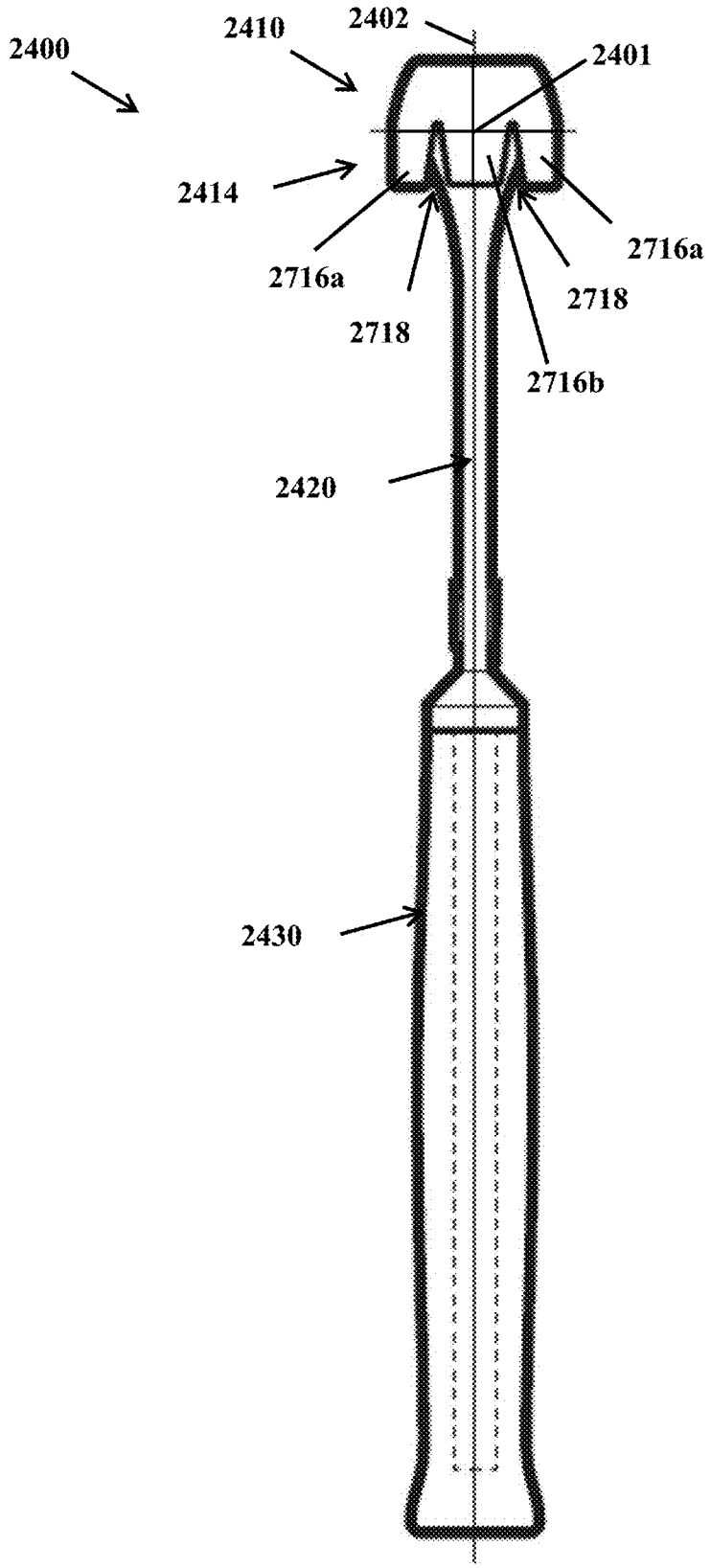
FIG. 27 is a back view of the roofing and nail removal hammer with smooth grip of FIG. 24, in accordance with another embodiment of the present invention.

FIG. 27 is a back view of the roofing and nail removal hammer with smooth grip of FIG. 24, in accordance with another embodiment of the present invention. In FIG. 27, the claw portion 2414 of the hammer 2400 is seen to include three teeth elements, two substantially equally sized outer teeth 2716*a* and one inner tooth 2716*b* with three substantially equally sized "V"-shaped grooves 2718 between the teeth 2716*a*, 2716*b* with the grooves 2718 being aligned on opposite sides of the vertical axis 2402. The inner tooth 1016*b* is about twice as wide as the outer teeth 2716*a*.

Figure 28:
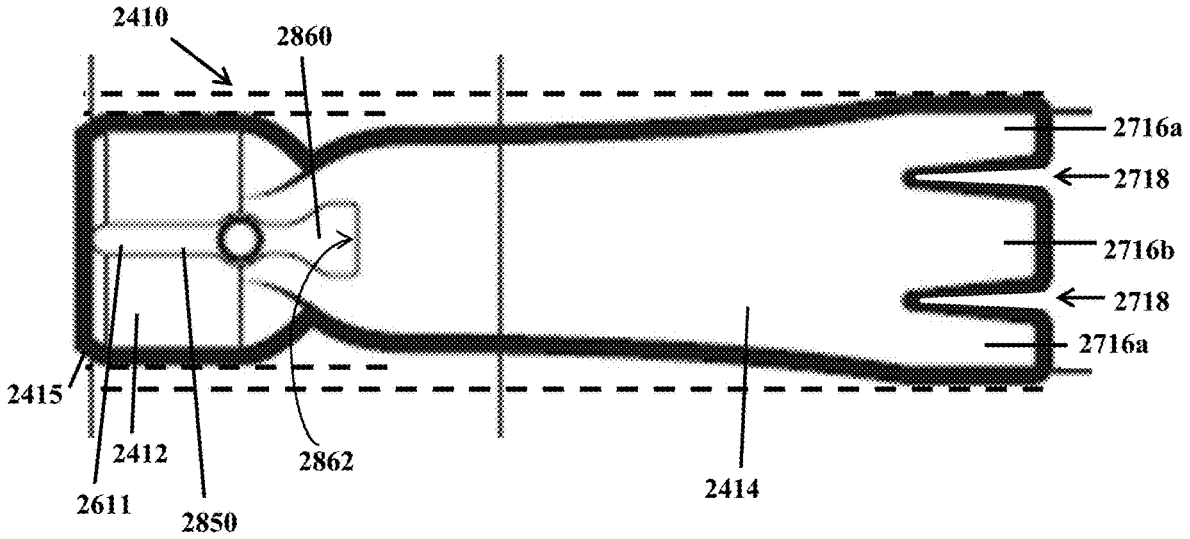
FIG. 28 is a top view of the roofing and nail removal hammer with smooth grip of FIG. 24, in accordance with another embodiment of the present invention.

FIG. 28 is a top view of the roofing and nail removal hammer with smooth grip of FIG. 24, in accordance with another embodiment of the present invention. In FIG. 28, the head 2410 of the hammer 2400 is seen with a maximum width of the end 2416 of the claw portion 2414 being wider than a width of the hammering portion 2412. In fact, the claw portion 2414 is approximately between 1⅛ to 1¼ times wider than the hammering portion 2412. In this embodiment, the head portion 2412 includes the nail groove 2611 that extends from adjacent the face 2413 and rearwardly along a top side of the hammering portion 2412 toward and onto the front end of the claw portion 2414. The groove 2611 has a substantially semicircular first section in the bottom of which is embedded a magnet 2850 to hold a nail for initial nailing. At an inside end of groove 2611 is an expanded opening 2860, which resembles a side view of a golf tee top and is configured to receive a nail head ranging from a common nail head shape to a finish nail head. An end wall of the expanded opening 2862 is configured to have a top of a nail head abut against it to permit an initial driving and/or application of the nail into a board or other substrate without a user of the hammer 2400 having to hold the nail. In embodiments, the hammer 2400 can have a length of about 14 to 15 inches, a claw width of about 1.5 to 1.6 inches, and a weight of from 12 to 16 ounces. In one embodiment, the hammer 2400 can have a length of about 14.375 inches, a claw width of about 1.57 inches, and a weight of about 12 ounces. In one embodiment, the hammer 2400 can have a length of about 14.375 inches, a claw width of about 1.57 inches, an outer tooth end width of about 0.3 inches, an inner tooth end width of about 0.5 inches, an open groove end width of about 0.25 inches, a groove depth of about 0.8 inches and a weight of about 12 ounces.

Figure 29:
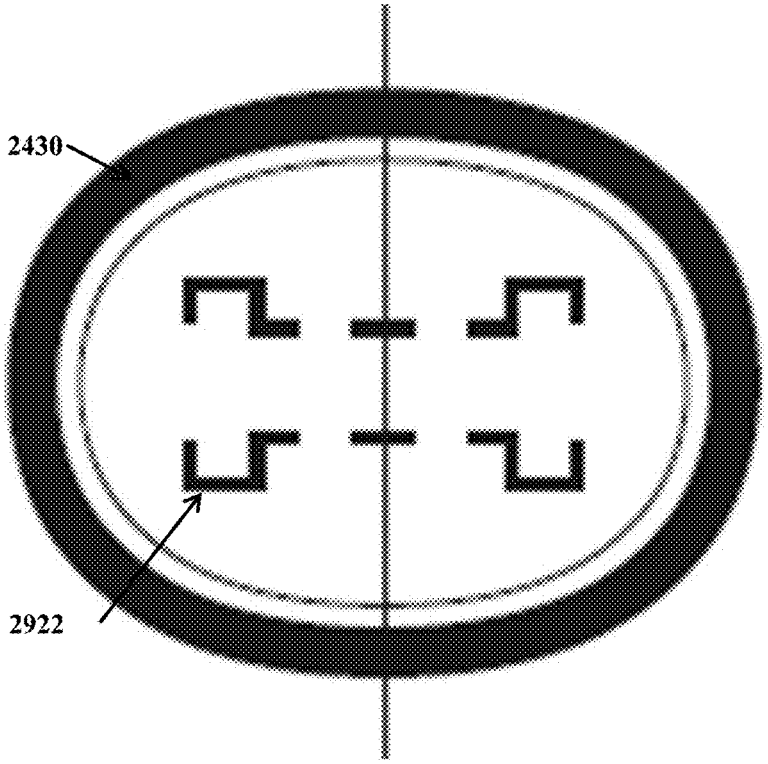
FIG. 29 is a bottom view of the roofing and nail removal hammer with smooth grip of FIG. 24, in accordance with another embodiment of the present invention.

FIG. 29 is a bottom view of the roofing and nail removal hammer with smooth grip of FIG. 24, in accordance with another embodiment of the present invention. In FIG. 29, an "I"-shaped end cross-section 2922 of the handle 2420 is shown in dashed line within the grip 2430. The "I"-shape 2922 of the handle provides additional support and strength to the handle 2420.

Figure 30:
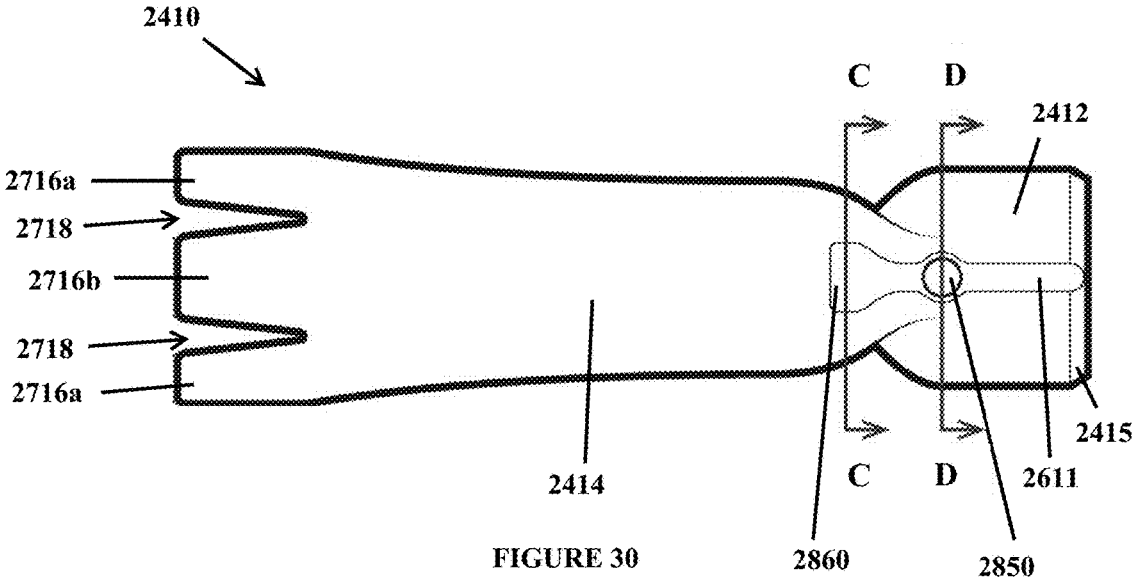
FIG. 30 is close up view of the top of the head of the roofing and nail removal hammer of FIG. 28, in accordance with another embodiment of the present invention.

FIG. 30 is close up view of the top of the head of the roofing and nail removal hammer of FIG. 28, in accordance with another embodiment of the present invention. In FIG. 30, two cross-section lines C-C and D-D are shown across nail groove 2611 and expanded opening 2860.

Figure 31:
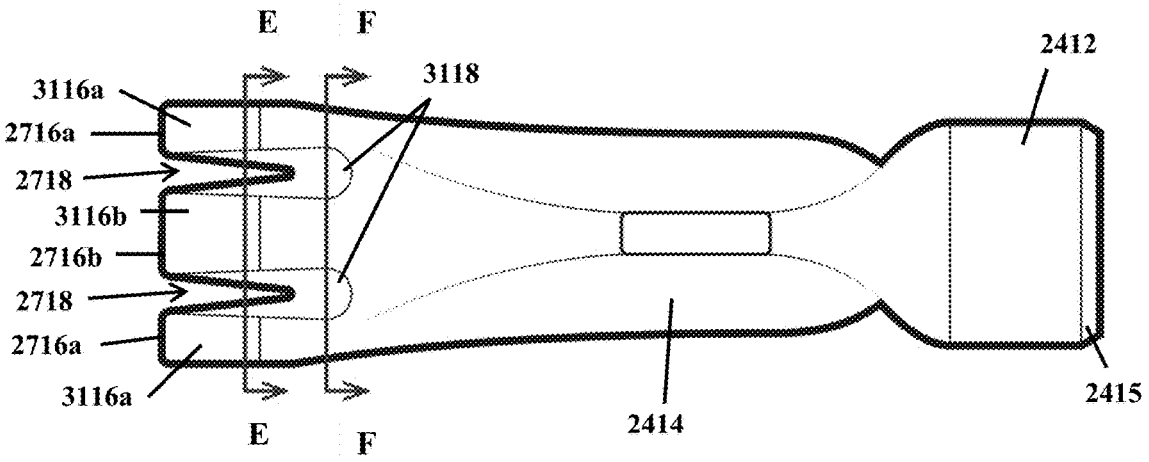
FIG. 31 is close up view of the bottom of the head of roofing and nail removal hammer of FIG. 28, in accordance with another embodiment of the present invention.

FIG. 31 is close up view of a bottom of the head of the roofing and nail removal hammer of FIG. 28, in accordance with another embodiment of the present invention. In FIG. 31, two cross-section lines E-E and F-F are shown across a pair of tapered grooves 2718 and a tapered recess 3118. As seen in FIG. 31, the outer teeth 2716*a* and inner tooth 2716*b* each have a tapered end section 3116*a* and 3116*b*, respectively. Each tapered end section 3116*a*, 3116*b* tapers from a thin end of each tooth, downwardly toward the end of each "V"-shaped groove 2718 and terminates approximately two-thirds (⅔) to three-quarters (¾) into the depth of the "V"-shaped grooves 2718. In addition, the tapered recess 3118 starts adjacent the ends of the inner and outer teeth 2716*a*, 2716*b* and extends toward the hammering portion 2712 and about 0.2 to 0.3 inches past the end of the "V"-shaped groove 2718 and includes a substantially rounded end, which is configured to slide under nail heads to facilitate the removal of the nails.

Figure 32:
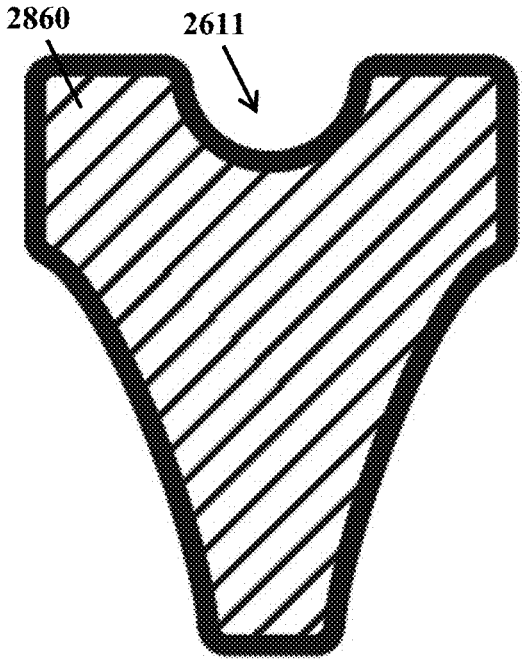
FIG. 32 is a cross-sectional view of the top of the roofing and nail removal hammer along line C-C of FIG. 30 showing the nail groove in the top of the hammer head, in accordance with another embodiment of the present invention.

FIG. 32 is a cross-sectional view of the top of the roofing and nail removal hammer along line C-C of FIG. 30 showing the nail groove in the top of the hammer head, in accordance with another embodiment of the present invention. In FIG. 32, the cross-sectional configuration of the expanded opening 2860 and the nail groove 2611 are seen looking from the front end of the claw portion 2414 toward the face 2413 of the hammering portion 2412. The substantially semicircular shape of the first section of the nail groove 2611 is clearly seen in the cross-section of FIG. 32.

Figure 33:
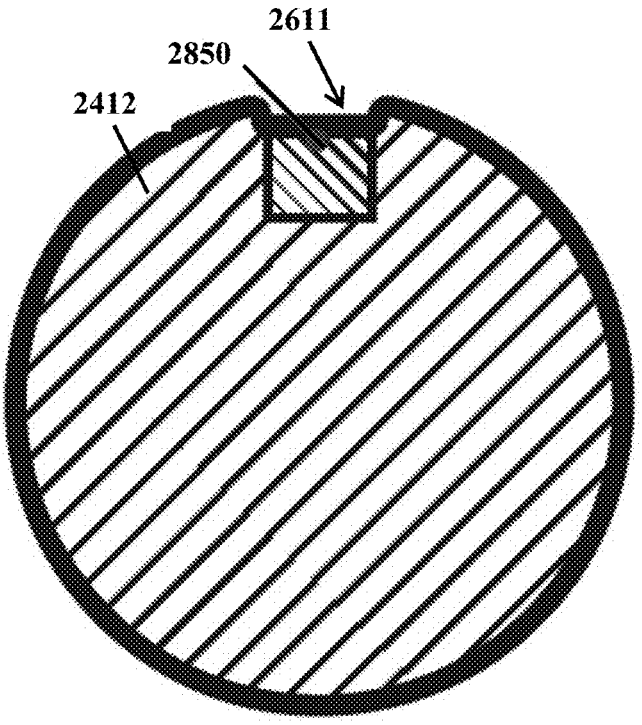
FIG. 33 is a cross-sectional view of the top of the roofing and nail removal hammer along line D-D of FIG. 30 showing the nail groove and magnet in the top of the hammer head, in accordance with another embodiment of the present invention.

FIG. 33 is a cross-sectional view of the top of the roofing and nail removal hammer along line D-D of FIG. 30 showing the nail groove and magnet in the top of the hammer head, in accordance with another embodiment of the present invention. In FIG. 33, the nail groove 2611 is shown in cross-section with the magnet 2850 embedded in the hammering portion 2412 in and below a bottom of the nail groove 2611. The magnet 2850 holds a nail within the nail groove 2611 and a head of the nail rests inside of and against a back surface of the expanded opening 2860 to permit an initial application of the nail to a board without the user having to hold the nail in his/her other hand. Although shown to have a substantially flat top surface, the magnet 2850 can also have a concave top shape that is substantially the same shape as the nail groove 2611.

Figure 34:
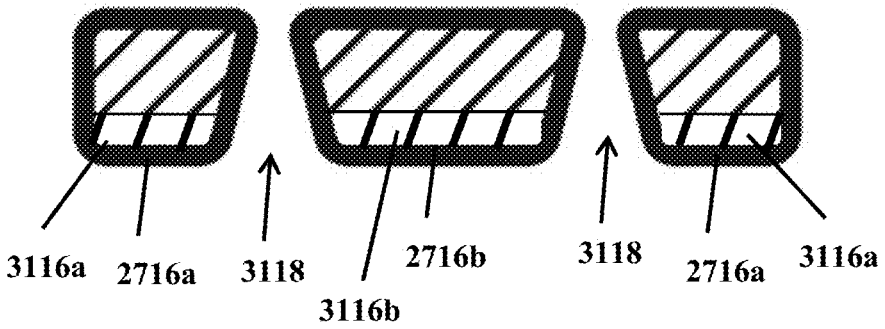
FIG. 34 is a cross-sectional view of the top of the roofing and nail removal hammer along line E-E of FIG. 31 showing the teeth and tapered grooves in the top of the hammer head, in accordance with another embodiment of the present invention.

FIG. 34 is a cross-sectional view of the top of the roofing and nail removal hammer along line E-E of FIG. 31 showing the teeth and tapered grooves in the top of the hammer head, in accordance with another embodiment of the present invention. In FIG. 34, the "V"-shaped grooves 3118 are defined by inner tapered sides of the two outer teeth 2716*a* and opposing tapered sides of the inner tooth 2716*b*. Top portions of the tapered sections 3116*a*, 3116*b* are seen at the bottom of the outer teeth 2716*a* and the inner tooth 2716*b*, respectively.

Figure 35:
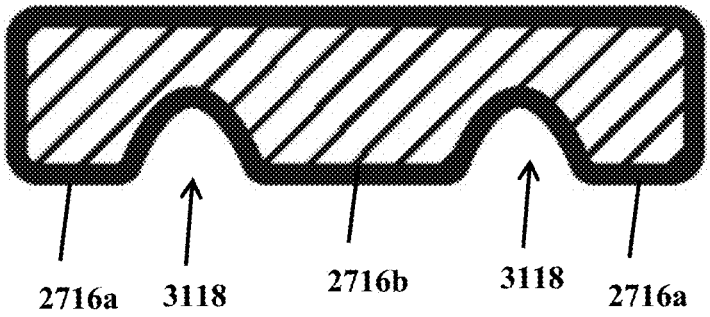
FIG. 35 is a cross-sectional view of the top of the roofing and nail removal hammer along line F-F of FIG. 31 showing tapered recesses in a bottom of the claw portion past the "V"-shaped grooves in the claw portion of the hammer head, in accordance with another embodiment of the present invention.

FIG. 35 is a cross-sectional view of the top of the roofing and nail removal hammer along line E-E of FIG. 31 showing tapered recesses in the claw portion past the apexes of the "V"-shaped grooves 2718 in the top of the claw portion of the hammer head, in accordance with another embodiment of the present invention. In FIG. 35, the tapered recesses 3118 are seen having a somewhat half-oval cross-section, although a shallower and more circular shape is also contemplated in other embodiments.

In an embodiment of the present invention, a hammer includes a head including a hammering portion and an oppositely arranged claw portion, the claw portion being at least 2 inches wide and including a back end with at least four flat ended teeth separated by at least three, substantially equal "V"-shaped grooves centered on a longitudinal axis of the head with inner edges of each of the "V"-shaped grooves being tapered along opposite sides of the "V"-shaped groove from adjacent a front of each tooth toward a sharp notch formed at a junction of the sides of the "V"-shaped groove and from a top side of each tooth inwardly toward a bottom side of each tooth, each tooth tapering to a smaller thickness adjacent its respective flat end, an outer two of the at least four teeth being substantially equally shaped to each other and an inner at least two of the at least four teeth being substantially equally shaped to each other with the outer two of the at least four teeth having substantially equal terminal widths that are wider than the at least inner two of the at least four teeth having substantially equal terminal widths. The hammer also includes a handle attached to the head and extending perpendicularly down from a bottom of the head; and a grip affixed to and surrounding a bottom portion of the handle from above a middle of the handle to below and surrounding a bottom end of the handle.

In an embodiment of the present invention, a hammer includes a head including a hammering portion and an oppositely arranged claw portion, the claw portion being at least 2 inches wide and including a back end with at least four flat ended teeth separated by at least three, substantially equal "V"-shaped grooves centered on a longitudinal axis of the head with inner edges of each of the "V"-shaped grooves being tapered along opposite sides of the "V"-shaped groove from adjacent a front of each tooth toward a sharp notch formed at a junction of the sides of the "V"-shaped groove and from a top side of each tooth inwardly toward a bottom side of each tooth, each tooth tapering to a smaller thickness adjacent its respective flat end, an outer two of the at least four teeth being substantially equally shaped to each other and an inner at least two of the at least four teeth being substantially equally shaped to each other with the outer two of the at least four teeth having substantially equal terminal widths that are wider than the at least inner two of the at least four teeth having substantially equal terminal widths. The hammer also includes a handle formed contiguously with the head and extending perpendicularly down from a bottom of the head; and a grip affixed to and surrounding a bottom portion of the handle from above a middle of the handle to below and surrounding a bottom end of the handle. The grip includes a downwardly and outwardly tapering upper portion connected to a middle portion having four raised ribs on opposite front and back sides of the grip, the middle portion being connected to an end portion with an outwardly tapering bottom portion and a rounded end, the grip further includes a cap portion attached to a top end of the upper portion and the cap portion including a bottom portion of the cap extending upwardly away from and substantially parallel to the upper portion of the grip and a top portion of the cap extending diagonally inwardly from the bottom toward and affixing to the handle.

In an embodiment of the present invention, a hammer includes a head including a hammering portion and an oppositely arranged claw portion, the claw portion being at least 2 inches wide and including a back end with at least four flat ended teeth separated by at least three, substantially equal "V"-shaped grooves centered on a longitudinal axis of the head with inner edges of each of the "V"-shaped grooves being tapered along opposite sides of the "V"-shaped groove from adjacent a front of each tooth toward a sharp notch formed at a junction of the sides of the "V"-shaped groove and from a top side of each tooth inwardly toward a bottom side of each tooth, each tooth tapering to a smaller thickness adjacent its respective flat end, an outer two of the at least four teeth being substantially equally shaped to each other and an inner at least two of the at least four teeth being substantially equally shaped to each other with the outer two of the at least four teeth having substantially equal terminal widths that are wider than the at least inner two of the at least four teeth having substantially equal terminal widths. The hammer also includes a handle formed contiguously with the head and extending perpendicularly down from a bottom of the head; and a grip affixed to and surrounding a bottom portion of the handle from above a middle of the handle to below and surrounding a bottom end of the handle. The grip including a downwardly and outwardly tapering upper portion to a middle portion from which the grip continues tapering downwardly and inwardly toward the bottom end of the handle with an outwardly tapering bottom portion and a substantially flat end, the grip further includes a cap portion attached to a top end of the upper portion and the cap portion including a bottom portion of the cap extending upwardly away from and substantially parallel to the upper portion of the grip and a top portion of the cap extending diagonally inwardly from the bottom toward and affixing to the handle.

In an embodiment of the present invention, a hammer includes a head including a hammering portion and an oppositely arranged claw portion, the claw portion being at least 1.5 inches wide and including a back end with at least three flat ended teeth separated by at least two, substantially equal "V"-shaped grooves centered on a longitudinal axis of the head with inner edges of each of the "V"-shaped grooves being tapered along opposite sides of the "V"-shaped groove from adjacent a front of each tooth toward a sharp notch formed at a junction of the sides of the "V"-shaped groove and from a top side of each tooth inwardly toward a bottom side of each tooth, each tooth tapering to a smaller thickness adjacent its respective flat end, an outer two of the at least three teeth being substantially equally shaped to each other and an inner tooth of the at least three teeth having a terminal width being substantially wider than the outer two of the at least three teeth. The hammer also includes a handle formed contiguously with the head and extending perpendicularly down from a bottom of the head. The hammer further includes a grip affixed to and surrounding a bottom portion of the handle from above a middle of the handle to below and surrounding a bottom end of the handle, the grip including a downwardly and outwardly tapering upper portion connected to a middle portion having four raised ribs on opposite front and back sides of the grip, the middle portion being connected to an end portion with an outwardly tapering bottom portion and a rounded end, the grip further including a cap portion attached to a top end of the upper portion and the cap portion including a bottom portion of the cap extending upwardly away from and substantially parallel to the upper portion of the grip and a top portion of the cap extending diagonally inwardly from the bottom toward and affixing to the handle.

While the invention(s) has/have been described in conjunction with a number of embodiments, it is evident that many alternatives, modifications and variations would be or are apparent to those of ordinary skill in the applicable arts. Accordingly, Applicant intends to embrace all such alternatives, modifications, equivalents, and variations that are within the spirit and scope of the invention(s) described herein.

What is claimed is:

1. An apparatus comprising:

a head including a hammering portion and an oppositely arranged claw portion, the hammering portion including a face, an outer surface, and a beveled edge connected to and tapering inwardly from a front end of the outer surface toward and connecting to and around an outside edge of the face, the claw portion curving downwardly and away from a top side of the head toward a base of the head, the base of the head extending substantially orthogonally downwardly away from the top side of the head with a bottom end of the base of the head defining an opening that extends upwardly toward the topside of the head, and the claw portion including a back end with at least four flat ended teeth separated by at least three, substantially equal "V"-shaped ¾ inch to 1 inch grooves centered on a longitudinal axis of the head with inner edges of each of the "V"-shaped grooves being tapered along opposite sides of the "V"-shaped groove from adjacent a front of each of the at least four teeth toward a sharp notch formed at a junction of the sides of the "V"-shaped groove and from a top side of each of the at least four teeth inwardly toward a bottom side of each of the at least four teeth, the outer two of the at least four teeth having substantially equal terminal widths that are wider than the at least inner two of the at least four teeth and all of the at least four teeth being substantially equal in length.

2. The apparatus of claim 1 further comprising a handle attached to the base of the head and extending perpendicularly down from the base of the head.

3. The apparatus of claim 2 wherein a bottom portion of the handle has an "I"-shape and the "I"-shaped portion is covered by a grip.

4. The apparatus of claim 3 wherein the grip is affixed to and surrounds the bottom portion of the handle, the grip including a downwardly and outwardly tapering upper portion to a middle portion from which the grip continues tapering downwardly and inwardly toward a bottom end of the handle with an outwardly tapering bottom portion and a substantially flat end, the grip further including a cap portion attached to a top end of the upper portion and the cap portion including a bottom portion of the cap portion extending upwardly away from and substantially parallel to the upper portion of the grip and a top portion of the cap portion extending diagonally inwardly from the bottom toward and affixed to the handle.

5. The apparatus of claim 1 wherein the head further includes a nail groove defined in a top of the head and extending from adjacent a front end of the hammering portion to the front end of the claw portion.

6. The apparatus of claim 5 further including a magnet affixed in the head and the groove.

7. The apparatus of claim 1 wherein the claw portion is at least 2 inches wide.

8. An apparatus comprising:

a head including a hammering portion and an oppositely arranged claw portion, the hammering portion including a face, an outer surface, and a beveled edge connected to and tapering inwardly from a front end of the outer surface toward and connecting to and around an outside edge of the face, the claw portion curving downwardly and away from a top side of the head toward a base of the head, the base of the head extending substantially orthogonally downwardly away from the top side of the head with a bottom end of the base of the head defining an opening that extends upwardly toward the topside of the head, and the claw portion and including a back end with at least four flat ended teeth separated by at least three, substantially equal "V"-shaped grooves centered on a longitudinal axis of the head with inner edges of each of the "V"-shaped grooves being tapered along opposite sides of the "V"-shaped groove from adjacent a front of each of the at least four teeth toward a sharp notch formed at a junction of the sides of the "V"-shaped groove and from a top side of each of the at least four teeth inwardly toward a bottom side of each of the at least four teeth, each of the at least four teeth tapering to a smaller thickness adjacent its respective flat end, outer two of the at least four teeth being substantially equally shaped to each other and at least two of the at least four teeth being substantially equally shaped to each other with the outer two of the at least four teeth having substantially equal terminal widths that are wider than the at least inner two of the at least four teeth having substantially equal terminal widths and all of the at least four teeth being substantially equal in length.

9. The apparatus of claim 8 further comprising a handle attached to the base of the head and extending perpendicularly down from the base of the head.

10. The apparatus of claim 9 wherein a bottom portion of the handle has an "I"-shape and the "I"-shaped portion is covered by a grip.

11. The apparatus of claim 10 wherein the grip is affixed to and surrounds the bottom portion of the handle, the grip including a downwardly and outwardly tapering upper portion to a middle portion from which the grip continues tapering downwardly and inwardly toward the bottom end of the handle with an outwardly tapering bottom portion and a substantially flat end, the grip further including a cap portion attached to a top end of the upper portion and the cap portion including a bottom portion of the cap portion extending upwardly away from and substantially parallel to the upper portion of the grip and a top portion of the cap portion extending diagonally inwardly from the bottom toward and affixed to the handle.

12. The apparatus of claim 8 wherein the head further includes a nail groove defined in a top of the head and extending from adjacent the front end of the hammering portion to the front end of the claw portion.

13. The apparatus of claim 12 further including a magnet affixed in the head and the groove.

14. The apparatus of claim 8 wherein the claw portion is at least 2 inches wide.

15. An apparatus comprising:

a head including a hammering portion and an oppositely arranged claw portion, the hammering portion including a face, an outer surface, and a beveled edge connected to and tapering inwardly from a front end of the outer surface toward and connecting to and around an outside edge of the face, the claw portion including a back end with at least four flat ended teeth separated by at least three, substantially equal "V"-shaped grooves centered on a longitudinal axis of the head with inner edges of each of the "V"-shaped grooves being tapered along opposite sides of the "V"-shaped groove from adjacent a front of each of the at least four teeth toward a sharp notch formed at a junction of the sides of the "V"-shaped groove and from a top side of each of the at least four teeth inwardly toward a bottom side of each of the at least four teeth, each of the at least four teeth tapering to a smaller thickness adjacent its respective flat end, outer two of the at least four teeth being substantially equally shaped to each other and at least inner two of the at least four teeth being substantially equally shaped to each other with the outer two of the at least four teeth having substantially equal terminal widths that are wider than the at least inner two of the at least four teeth having substantially equal terminal widths and all of the at least four teeth being substantially equal in length, a base of the head extending substantially orthogonally downwardly away from a top side of the head with a bottom end of the base of the head defining an opening that extends upwardly toward the topside of the head, and the claw portion curving downwardly and away from the top side of the head toward the base of the head.

16. The apparatus of claim 15 wherein the claw portion is at least 2 inches wide and curves downwardly and away from the top side of the head toward a handle.

17. The apparatus of claim 16 wherein the head further includes a nail groove defined in a top of the head and extending from adjacent the front end of the hammering portion to the front end of the claw portion.

18. The apparatus of claim 17 further including a magnet affixed in the head and the groove.

19. The apparatus of claim 15 further comprising a handle formed contiguously with the head and extending perpendicularly down from a bottom of the head wherein a bottom portion of the handle has an "I"-shape that is covered by a grip.

20. The apparatus of claim 19 wherein the grip is affixed to and surrounds the bottom portion of the handle, the grip includes a downwardly and outwardly tapering upper portion connected to a middle portion having four raised ribs on opposite front and back sides of the grip, the middle portion is connected to an end portion with an outwardly tapering bottom portion and a rounded end, the grip further includes a cap portion attached to a top end of the upper portion and the cap portion includes a bottom portion of the cap portion extending upwardly away from and substantially parallel to the upper portion of the grip and a top portion of the cap portion extending diagonally inwardly from the bottom toward and affixed to the handle.

21. The apparatus of claim 20 wherein four grooves are formed between and below the four raised ribs on the front and back of the grip.

22. An apparatus comprising:

a head including a hammering portion and an oppositely arranged claw portion, the hammering portion including a face, an outer surface, and a beveled edge connected to and tapering inwardly from a front end of the outer surface toward and connecting to and around an outside edge of the face, the claw portion being at least 2 inches wide and including a back end with at least four flat ended teeth separated by at least three, substantially equal "V"-shaped grooves centered on a longitudinal axis of the head with inner edges of each of the "V"-shaped grooves being tapered along opposite sides of the "V"-shaped groove from adjacent a front of each of the at least four teeth toward a sharp notch formed at a junction of the sides of the "V"-shaped groove and from a top side of each of the at least four teeth inwardly toward a bottom side of each of the at least four teeth, each of the at least four teeth tapering to a smaller thickness adjacent its respective flat end, outer two of the at least four teeth being substantially equally shaped to each other and at least inner two of the at least four teeth being substantially equally shaped to each other with the outer two of the at least four teeth having substantially equal terminal widths that are wider than the at least inner two of the at least four teeth having substantially equal terminal widths and all of the at least four teeth being substantially equal in length, a base of the head extending substantially orthogonally downwardly away from a top side of the head with a bottom end of the base of the head defining an opening that extends upwardly toward the topside of the head, and the claw portion, the claw portion curving downwardly and away from the top side of the head toward the base of the head.

23. The apparatus of claim 22 further comprising a handle extending perpendicularly down from a bottom of the head and a bottom portion of the handle has an "I"-shape and is covered by a grip.

24. The apparatus of claim 23 wherein the grip is affixed to and surrounds the bottom portion of the handle, the grip includes a downwardly and outwardly tapering upper portion to a middle portion from which the grip continues tapering downwardly and inwardly toward the bottom end of the handle with an outwardly tapering bottom portion and a substantially flat end, the grip further includes a cap portion attached to a top end of the upper portion and the cap portion includes a bottom portion of the cap portion extending upwardly away from and substantially parallel to the upper portion of the grip and a top portion of the cap portion extending diagonally inwardly from the bottom toward and affixed to the handle.

25. The apparatus of claim 24 wherein the head further includes a nail groove defined in a top of the head and extending from adjacent the front end of the hammering portion to the front end of the claw portion.

26. The apparatus of claim 25 further including a magnet affixed in the head and the groove.

27. An apparatus comprising:

a head including a hammering portion and an oppositely arranged claw portion, the hammering portion including a face, an outer surface, and a beveled edge connected to and tapering inwardly from a front end of the outer surface toward and connecting to and around an outside edge of the face, the claw portion including a back end with at least three flat ended teeth separated by at least two, substantially equal "V"-shaped grooves centered on a longitudinal axis of the head with inner edges of each of the "V"-shaped grooves being tapered along opposite sides of the "V"-shaped groove from adjacent a front of each of the at least three teeth toward a sharp notch formed at a junction of the sides of the "V"-shaped groove and from a top side of each of the at least three teeth inwardly toward a bottom side of each of the at least three teeth, each of the at least three teeth tapering to a smaller thickness adjacent its respective flat end, the outer two of the at least three teeth being substantially equally shaped to each other and an inner one of the at least three teeth having a terminal width being substantially wider than the outer two of the at least three teeth and all of the at least three teeth being substantially equal in length, a base of the head extending substantially orthogonally downwardly away from a top side of the head with a bottom end of the base of the head defining an opening that extends upwardly toward the topside of the head, and the claw portion, the claw portion curving downwardly and away from the top side of the head toward the base of the head.

28. The apparatus of claim 27 wherein the claw portion is at least 1.5 inches wide and curves downwardly and away from the top side of the head toward the base of the head.

29. The apparatus of claim 28 wherein the head further includes a nail groove defined in a top of the head and extending from adjacent the front end of the hammering portion to the front end of the claw portion.

30. The apparatus of claim 29 further including a magnet affixed in the head and the groove.

31. The apparatus of claim 27 wherein a bottom portion of a handle has an "I"-shape and is covered by a grip.

32. The apparatus of claim 31 wherein the grip includes a downwardly and outwardly tapering upper portion connected to a middle portion from which the grip continues tapering downwardly and inwardly toward the bottom end of the handle with an outwardly tapering bottom portion and a substantially flat end, the grip further includes a cap portion attached to a top end of the upper portion and the cap portion includes a bottom portion of the cap portion extending upwardly away from and substantially parallel to the upper portion of the grip and a top portion of the cap portion extending diagonally inwardly from the bottom toward and affixed to the handle.

33. The apparatus of claim 31 wherein the grip affixed to and surrounding the bottom portion of the handle, the grip includes a downwardly and outwardly tapering upper portion connected to a middle portion having four raised ribs on opposite front and back sides of the grip, the middle portion being connected to an end portion with an outwardly tapering bottom portion and a rounded end, the grip further includes a cap portion attached to a top end of the upper portion and the cap portion includes a bottom portion of the cap portion extending upwardly away from and substantially parallel to the upper portion of the grip and a top portion of the cap extending diagonally inwardly from the bottom toward and affixed to the handle.

34. The apparatus of claim 33 wherein four grooves are formed between and below the four raised ribs on the front and back of the grip.

* * * * *